US010373566B2

(12) United States Patent
Lee et al.

(10) Patent No.: US 10,373,566 B2
(45) Date of Patent: Aug. 6, 2019

(54) ORGANIC LIGHT EMITTING DIODE DISPLAY DEVICE AND DISPLAY SYSTEM INCLUDING THE SAME

(71) Applicant: SAMSUNG DISPLAY CO., LTD., Yongin, Gyeonggi-Do (KR)

(72) Inventors: Jae-Sic Lee, Seoul (KR); Jin-Woo Park, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 309 days.

(21) Appl. No.: 14/809,099

(22) Filed: Jul. 24, 2015

(65) Prior Publication Data

US 2016/0240146 A1 Aug. 18, 2016

(30) Foreign Application Priority Data

Feb. 16, 2015 (KR) ..... 10-2015-0023004

(51) Int. Cl.
*G09G 3/20* (2006.01)
*G09G 3/3291* (2016.01)
*G09G 3/3258* (2016.01)

(52) U.S. Cl.
CPC ..... *G09G 3/3291* (2013.01); *G09G 3/2003* (2013.01); *G09G 3/3258* (2013.01);
(Continued)

(58) Field of Classification Search
CPC ... G09G 2300/0452; G09G 2310/0224; G09G 2310/0262; G09G 2310/0278;
(Continued)

(56) References Cited

U.S. PATENT DOCUMENTS

2002/0063670 A1* 5/2002 Yoshinaga ..... G09G 3/3413 345/87
2002/0186214 A1 12/2002 Siwinski
(Continued)

FOREIGN PATENT DOCUMENTS

EP 2012300 A1 1/2009
KR 10-2010-0045657 A 5/2010
(Continued)

OTHER PUBLICATIONS

EPO Extended Search Report dated Jul. 4, 2016, for corresponding European Patent Application No. 15188734.6 (23 pages).
(Continued)

*Primary Examiner* — Ram A Mistry
(74) *Attorney, Agent, or Firm* — Lewis Roca Rothgerber Christie LLP

(57) ABSTRACT

An organic light emitting diode (OLED) display device includes a display panel including a plurality of pixel rows; a driving circuit configured to: provide a first display data to the plurality of pixel rows in a normal mode; provide a second display data including black data to the plurality of pixel rows in a dimming mode, in response to a mode signal; and decrease a second luminance of the display panel in the dimming mode to a level lower than a first luminance of the display panel in the normal mode; and a power supply configured to apply a lower power supply voltage and a high power supply voltage to the display panel, the power supply providing the mode signal.

20 Claims, 26 Drawing Sheets

(52) U.S. Cl.
CPC ..... *G09G 2300/0452* (2013.01); *G09G 2310/0224* (2013.01); *G09G 2310/0262* (2013.01); *G09G 2310/0278* (2013.01); *G09G 2310/08* (2013.01); *G09G 2320/0242* (2013.01); *G09G 2320/0626* (2013.01); *G09G 2330/021* (2013.01); *G09G 2330/023* (2013.01); *G09G 2330/028* (2013.01); *G09G 2340/0407* (2013.01); *G09G 2370/08* (2013.01)

(58) Field of Classification Search
CPC ..... G09G 2310/08; G09G 2320/0242; G09G 2320/0626; G09G 2330/021; G09G 2330/023; G09G 2330/028; G09G 2340/0407; G09G 2370/08; G09G 3/2003; G09G 3/3258; G09G 3/3291
See application file for complete search history.

(56) References Cited

U.S. PATENT DOCUMENTS

2006/0044251 A1 3/2006 Kato et al.
2007/0057877 A1* 3/2007 Choi ..... G09G 3/3233 345/76
2008/0117231 A1* 5/2008 Kimpe ..... G09G 3/20 345/629
2010/0277463 A1 11/2010 Yen et al.
2011/0069089 A1* 3/2011 Kopf ..... G09G 3/3208 345/690
2013/0027444 A1* 1/2013 Chui ..... G02B 26/001 345/694
2013/0208021 A1 8/2013 Lee et al.
2013/0314454 A1 11/2013 Jin et al.

FOREIGN PATENT DOCUMENTS

KR 10-2011-0001902 1/2011
KR 10-2011-0070392 A 6/2011
KR 10-2013-0097964 A 9/2013
KR 10-2014-0087915 7/2014

OTHER PUBLICATIONS

Unknown, OLED-Info.com Web Article, "PenTile RGBG Matrix Technology Explained," OLED News and Information © 2004-2014 Metalgrass Software, Jul. 9, 2015, 2 pages, XP55211594A; http://www.oled-info.com/pentile.
EPO Office Action dated Jul. 11, 2018, for corresponding European Patent Application No. 15188734.6 (11 pages).

* cited by examiner

DTAP2

DTAP21_0

DTAP21_E

DTAP22_0

DTAP22_E

DTAP23_0

DTAP23_E

DTAP24_0

DTAS1

DTAS21_0

DTAS21_E

DTAS22_O

DTAS22_E

DTAS23_0

DTAS23_E

DTAS24_0

DTAS24_E

DTAS25_0

DTAS25_E

DTAS26_0

DTAS26_E

DTAS27_0

DTAS27_E

ORGANIC LIGHT EMITTING DIODE DISPLAY DEVICE AND DISPLAY SYSTEM INCLUDING THE SAME

CROSS-REFERENCE TO RELATED APPLICATION

This application claims priority to and the benefit of Korean Patent Application No. 10-2015-0023004, filed on Feb. 16, 2015 in the Korean Intellectual Property Office (KIPO), the content of which is incorporated herein in its entirety by reference.

BACKGROUND

1. Field

Aspects of one or more example embodiments of the present invention relate to display devices.

2. Description of the Related Art

Various flat panel display devices that have a relatively reduced weight and volume, compared to other display devices, have been developed. Flat panel display devices include liquid crystal display (LCD) devices, field emission display (FED) devices, plasma display panels (PDPs), organic light emitting display (OLED) devices, etc. OLED devices may have characteristics such as relatively rapid response speed and low power consumption, when compared to other flat panel display devices because OLED devices display images using organic light emitting diodes that emit light based on recombination of electrons and holes.

The above information disclosed in this Background section is only for enhancement of understanding of the background of the invention and therefore it may contain information that does not constitute prior art.

SUMMARY

Aspects of one or more example embodiments of the present invention relate to display devices, organic light emitting diode (OLED) display devices, and display systems including the same.

According to some example embodiments of the present invention, an OLED display device may be capable of preventing or reducing image quality degradation while also reducing power consumption.

According to some example embodiments of the present invention, a display system may include an OLED display device capable of preventing or reducing image quality degradation while reducing power consumption.

According to some example embodiments of the present invention, an organic light emitting diode (OLED) display device includes: a display panel including a plurality of pixel rows; a driving circuit configured to: provide a first display data to the plurality of pixel rows in a normal mode; provide a second display data including black data to the plurality of pixel rows in a dimming mode, in response to a mode signal; and decrease a second luminance of the display panel in the dimming mode to a level lower than a first luminance of the display panel in the normal mode; and a power supply configured to apply a lower power supply voltage and a high power supply voltage to the display panel, the power supply providing the mode signal.

The plurality of pixel rows may include a plurality of odd-numbered pixel rows and a plurality of even-numbered pixel rows that are alternately arranged with respect to each other, wherein each of the plurality of odd-numbered pixel rows may include first pixels and second pixels that are alternately arranged with respect to each other, wherein each of the plurality of even-numbered pixel rows may include third pixels and fourth pixels that are alternately arranged with respect to each other, and wherein each first pixel may include a first sub pixel configured to emit a first color light and a second sub pixel configured to emit a second color light, each second pixel may include a third sub pixel configured to emit a third color light and the second sub pixel configured to emit the second color light, each third pixel may include the third sub pixel and the second sub pixel and each fourth pixel may include the first sub pixel and the second sub pixel.

The driving circuit may be configured to provide black data to the second sub pixels of the second pixel and the fourth pixel in the dimming mode.

The driving circuit, in the diming mode, may be configured to: provide black data to the second sub pixels of the second pixel and the fourth pixel during a k-th frame period (k is an integer greater than 0); and provide the black data to the second sub pixels of the first pixel and the third pixel during a (k+1)-th frame period.

The driving circuit, in the diming mode, may be configured to: provide black data to the second sub pixels of the second pixel and the third pixel during a k-th frame period (k is an integer greater than 0); and provide the black data to the second sub pixels of the first pixel and the fourth pixel during a (k+1)-th frame period.

The driving circuit, in the diming mode, may be configured to: provide black data to the pixels in the even-numbered pixel rows during a k-th frame period (k is an integer greater than 0); and provide the black data to the pixels in the odd-numbered pixel rows during a (k+1)-th frame period.

The driving circuit, in the diming mode, may be configured to: provide black data to the second pixels and the fourth pixels during a k-th frame period (k is an integer greater than 0); and provide the black data to the first pixels and the third pixels during a (k+1)-th frame period.

The first color light may be a red color light, the second color light may be a green color light and the third color light may be a blue color light.

The plurality of pixel rows may include a plurality of odd-numbered pixel rows and a plurality of even-numbered pixel rows that are alternately arranged with respect to each other, wherein each of the plurality of odd-numbered pixel rows may include first pixels and second pixels that are alternately arranged with respect to each other, wherein each of the plurality of even-numbered pixel rows may include third pixels and fourth pixels that are alternately arranged with respect to each other, and wherein each of the first through fourth pixels may include a first sub pixel configured to emit a first color light, a second sub pixel configured to emit a second color light, and a third sub pixel configured to emit a third color light.

The driving circuit, in the diming mode, may be configured to: provide black data to a same pixel of the first pixel and the third pixel during a k-th frame period (k is an integer greater than 0); and provide the black data to a same sub pixel of the second pixel and the fourth pixel during a (k+1)-th frame period.

The same sub pixel may be one of the first through third sub pixels.

The driving circuit, in the diming mode, may be configured to: provide black data to a same pixel of the first pixel and the fourth pixel during a k-th frame period (k is an integer greater than 0); and provide the black data to the same sub pixel of the second pixel and the third pixel during a (k+1)-th frame period.

The same sub pixel may be one of the first through third sub pixels.

The driving circuit, in the diming mode, may be configured to: provide black data to the first pixel and the fourth pixel during a k-th frame period (k is an integer greater than 0); and provide the black data to the second pixel and the third pixel during a (k+1)-th frame period.

The first color light may be a red color light, the second color light may be a green color light, and the third color light may be a blue color light.

The driving circuit may include: a scan driver configured to provide scan signals to the sub pixels through a plurality of scan lines; a data driver configured to provide data voltages corresponding to the first display data or the second display data to the sub pixels through a plurality of data lines; an emission driver configured to provide emission control signals to the sub pixels through a plurality of a plurality of emission control lines to adjust non-emission time of each sub pixels in the dimming mode; a timing controller configured to control the scan driver, the data driver, the emission driver and the power supply, and the timing controller may be configured to process an input image data to generate the first display data or the second display data in response to the mode signal.

Each of the sub pixels may include: a switching transistor including a first terminal coupled to each of the data lines, a gate terminal coupled to each of the scan lines and a second terminal coupled to a first node; a storage capacitor between the high power supply voltage and the first node; a driving transistor including a first terminal coupled to the high power supply voltage, a gate terminal coupled to the first node and a second terminal; an emission transistor including a first terminal coupled to a second terminal of the driving transistor, a gate terminal configured to receive the emission control signal and a second terminal; and an OLED between the second terminal of the driving transistor and a lower power supply voltage.

The timing controller may include: a signal generator configured to generate a first driving control signal that controls the data driver, a second driving control signal that controls the scan driver, a third driving control signal that controls the emission driver and a power control signal that controls the power supply, in response to a control signal and the mode signal; and a data converter configured to convert the input image data to the first display data or the second display data in response to the mode signal.

The data converter may include: a first processing logic configured to process the input image data to provide the first display data to the data driver in the normal mode; a second processing logic configured to process the input image data to provide the second display data to the data driver in the dimming mode; and a switching circuit configured to determine a path of the input image data to one of the first processing logic and the second processing logic in response to the mode signal.

According to some embodiments of the present invention, a display system includes: an application processor configured to generate image data and a control signal; an organic light emitting diode (OLED) display device configured to display the image data in response to the control signal; and a power supply comprising a battery configured to provide a power supply voltage to the OLED display device and a battery sensing module configured to detect a power of the battery, wherein the OLED display device comprises: a display panel comprising a plurality of pixel rows; and a driving circuit configured to: provide a first display data to the plurality of pixel rows in a normal mode; provide a second display data including black data to the plurality of pixel rows in a dimming mode, in response to a mode signal; and reduce a second luminance of the display panel in the dimming mode to a lower level than a first luminance of the display panel in the normal mode, the mode signal being based on a battery sensing signal that the battery sensing module generates based on the power of the battery.

Accordingly, the OLED display device and the display system may operate in a normal mode or a dimming mode in which luminance of the display panel is reduced based on a battery sensing signal. The OLED display device and the display system may convert the image data to a first display data not including the black data, to display the first display data in the display panel in the normal mode and converts the image data to a second display data including the black data, to display the second display data in the display panel in the dimming mode while reducing non-emission periods to prevent the stripe pattern in the dimming mode.

BRIEF DESCRIPTION OF THE DRAWINGS

Example embodiments of the present invention will be more clearly understood from the following detailed description taken in conjunction with the accompanying drawings.

DETAILED DESCRIPTION

Figure 1:
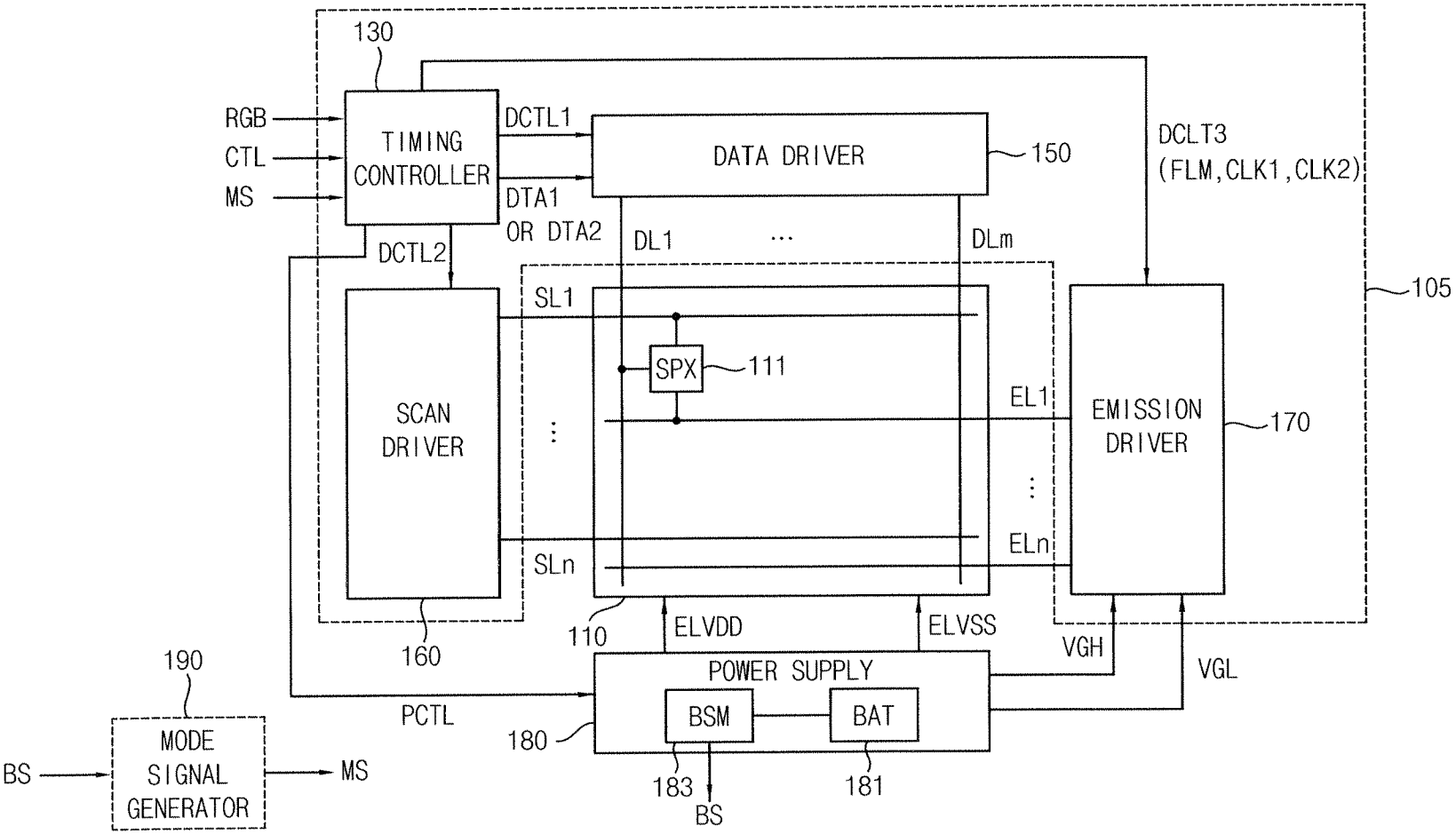
FIG. 1 is a block diagram illustrating an organic light emitting diode (OLED) display device, according to some example embodiments of the present invention.

The example embodiments are described more fully hereinafter with reference to the accompanying drawings. The present invention may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the present invention. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The example embodiments are described more fully hereinafter with reference to the accompanying drawings. Like or similar reference numerals refer to like or similar elements throughout.

FIG. 1 is a block diagram illustrating an organic light emitting diode (OLED) display device according to some example embodiments of the present invention.

Referring to FIG. 1 an OLED display device 100 may include a driving circuit 105, a display panel 110, and a power supply 180.

The driving circuit 105 may include a timing controller 130, a data driver 150, a scan driver 160, and an emission driver 170. According to some embodiments of the present invention, the OLED display device 100 may further include a mode signal generator 190. The timing controller 130, the data driver 150, the scan driver 160, and the emission driver 170 may be coupled to the display panel 110 by a chip-on flexible printed circuit (COF), a chip-on glass (COG), a flexible printed circuit (FPC), etc.

The display panel 110 may be coupled to the scan driver 160 of the driving circuit 105 through a plurality of scan lines SL1~SLn (n is an integer greater than one), may be coupled to the data driver 150 through a plurality of data lines DL1~DLm (m is an integer greater than one), and may be coupled to the emission driver 170 of the driving circuit 220 through a plurality of emission control lines EL1~ELn. The display panel 110 may include a plurality of sub pixels 111, and each sub pixel 111 is arranged at an intersection of each of the scan lines SL1~SLn, each of the data lines DL1~DLm and each of the emission control lines EL1~ELn.

The power supply 180 may provide a high power supply voltage ELVDD and a lower power supply voltage ELVSS to the display panel 110. The power supply 180 may provide a first voltage VGL and a second voltage VGH to the emission driver 170.

The scan driver 160 may apply a scan signal to each of the sub pixels 111 through the plurality of scan lines SL1~SLn based on a second driving control signal DCTL2.

The data driver 150 may apply a data voltage to each of the sub pixels 111 through the plurality of data lines DL1~DLm based on a first driving control signal DCTL1. The data driver 150 may apply a data voltage to each of the sub pixels 111 based on a first display data DTA1 not including black data in a normal mode and may apply a data voltage to each of the sub pixels 111 based on a second display data DTA2 including black data in a dimming mode.

The emission driver 170 may apply an emission control signal to each of the sub pixels 111 through the plurality of emission control lines EL1~ELn based on a third driving control signal DCTL3. Luminance of the display panel 110 may be adjusted based on the emission control signal.

The power supply 180 may provide the high power supply voltage ELVDD and the lower power supply voltage ELVSS to the display panel 110, and may provide the first voltage VGL and the second voltage VGH to the emission driver 170, in response to a power control signal. In an embodiment, the power supply 180 may include a rechargeable battery 181 and a battery sensing module 183. The battery sensing module 183 may sense remaining power of the rechargeable battery 181 to output a battery sensing signal BS.

The timing controller 130 may receive input image data RGB, a control signal CTL and a mode signal MS, and may generate the first through third driving control signals DCTL1~DCTL3 and the power control signal PCTL. The timing controller 130 may provide the first driving control signal DCTL1 to the data driver 150, the second driving control signal DCTL2 to the scan driver 160, the third driving control signal DCTL3 to the emission driver 170 and the power control signal PCTL to the power supply 180. The third driving control signal DCTL3 may include a start signal FLM (frame line mark), a first clock signal CLK1 and a second clock signal CLK2.

The timing controller 130 may convert the input image data RGB to the first display data DTA1 or the second display data DTA2 in response to the mode signal MS. When the mode signal MS directs the normal mode, the timing controller 130 may convert the input image data RGB to the first display data DTA1 to be provided to the data driver 150. When the mode signal MS directs the dimming mode, the timing controller 130 may convert the input image data RGB to the second display data DTA2 to be provided to the data driver 150.

The mode signal generator 190 may generate the mode signal MS that determines a mode of the display panel 110 in response to the battery sensing signal BS that indicates the remaining power of the rechargeable battery 181. The mode signal generator 190 may be included in the power supply 180.

Figure 2:
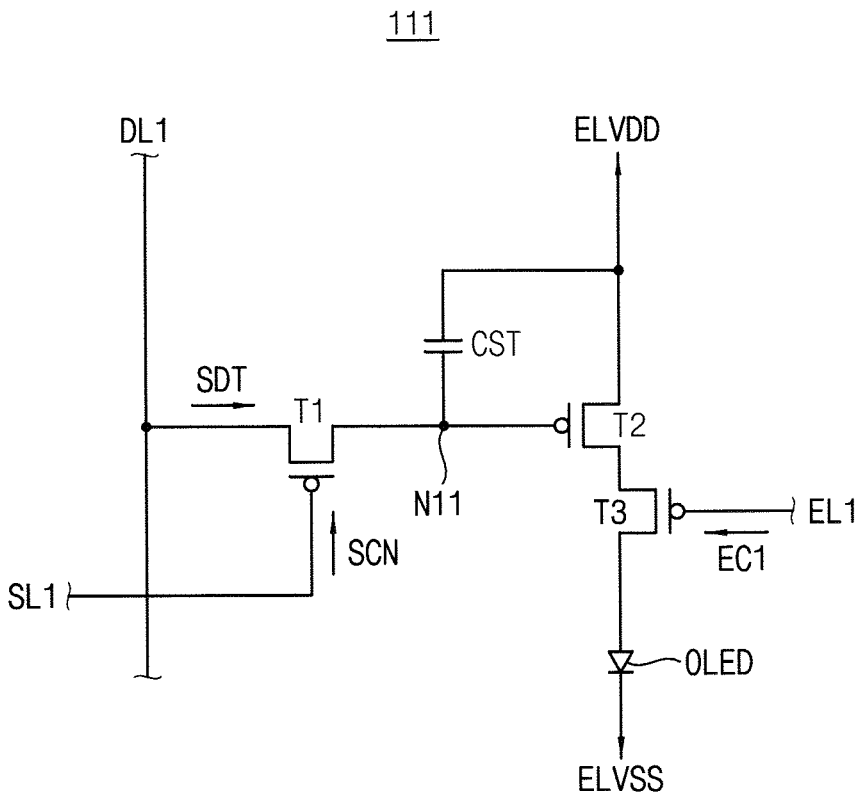
FIG. 2 is a circuit diagram illustrating an example of the sub pixel in the OLED display device of FIG. 1.

FIG. 2 is a circuit diagram illustrating an example of the sub pixel in the OLED display device of FIG. 1.

Referring to FIG. 2, each sub pixel 111 of the display panel 110 may include a switching transistor T1, a storage capacitor CST, a driving transistor T2, an emission transistor T3, and an OLED.

The switching transistor T1 may include a p-channel metal-oxide semiconductor (PMOS) transistor that has a first terminal coupled to a data line DL11 to receive a data voltage SDT, a gate terminal coupled to a scan line SL1 to receive a scan signal SCN, and a second terminal coupled to a first node N1. The driving transistor T2 may include a PMOS transistor that has a first terminal coupled to the high power supply voltage ELVDD, a gate terminal coupled to the first node N1, and a second terminal coupled to the low power supply voltage ELVSS. The storage capacitor CST may have a first terminal coupled to the high power supply voltage ELVDD and a second terminal coupled to the first node N1. The emission transistor T3 may include a PMOS transistor that has a first terminal coupled to a second terminal of the driving transistor T2, a second terminal coupled to the OLED and a gate terminal, coupled to an emission control line EL1, receiving an emission control signal EC1. The organic light emitting diode OLED may have an anode electrode coupled to the second terminal of the emission transistor T3 and a cathode electrode coupled to the low power supply voltage ELVSS.

The switching transistor T1 transfers the data voltage SDT to the storage capacitor CST in response to the scan signal SCN and the organic light emitting diode OLED may emit light in response to the data voltage SDT stored in the storage capacitor CST to display image.

In example embodiments, the sub pixels 111 of the display panel 110 may be driven in a digital driving method. In the digital driving method of the pixel, the driving transistor T2 is operated as a switch in a linear region. Accordingly, the driving transistor T2 represents (or may operate in) one of a turn on state and a turn off state.

To turn on or turn off the driving transistor T2, the data voltage SDT having two levels including a turn on level and a turn off level are used. In the digital driving method, the pixel represents one of the turn on state and the off state so that a single frame may be divided into a plurality of subfields to represent various grayscales. The turn on status and the turn off status of the pixel during each of the subfields are combined so that the various grayscales of the pixel may be represented.

The emission transistor T3 is turned on or turned off in response to the emission control signal EC1 to provide a current to the organic light emitting diode OLED or to intercept a current from the organic light emitting diode OLED. When the current is intercepted from the organic light emitting diode OLED, the organic light emitting diode OLED does not emit light. Therefore, the emission transistor T3 is turned on or turned off in response to the emission control signal EC1 to adjust a luminance of the display panel 110. When the display panel 110 is in the dimming mode in response to the mode signal MS, the power consumption of the display panel 110 may be reduced by adjusting an activation interval of the emission control signal EC1 to reduce the luminance of the display panel 110.

Figure 3:
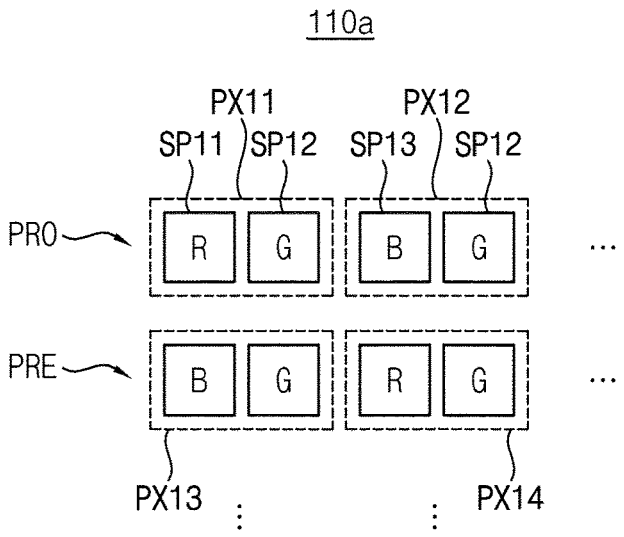
FIG. 3 illustrates an example of the display panel in the OLED display device of FIG. 1.

FIG. 3 illustrates an example of the display panel in the OLED display device of FIG. 1.

Referring to FIG. 3, a display panel 110*a* may include a plurality of odd-numbered pixel rows PRO and a plurality of even-numbered pixel rows PRE that are alternately arranged with respect to each other. Each of the odd-numbered pixel rows PRO may include first pixels PX11 and second pixels PX12 that are alternately arranged with respect to each other. Each of the even-numbered pixel rows may include third pixels PX13 and fourth pixels PX14 that are alternately arranged with respect to each other.

Each first pixel PX11 includes a first sub pixel SP11 emitting a first color light and a second sub pixel SP12 emitting a second color light, each second pixel PX12 includes a third sub pixel SP13 emitting a third color light and the second sub pixel SP12 emitting the second color light, each third pixel PX13 includes the third sub pixel and the second sub pixel and each fourth pixel PX14 includes the first sub pixel and the second sub pixel. In an embodiment, the first color light may be a red color light, the second color light may be a green color light and the third color light may be a blue color light. That is, the display panel 110*a* of FIG. 3 may be a pentile configuration.

Figure 4:
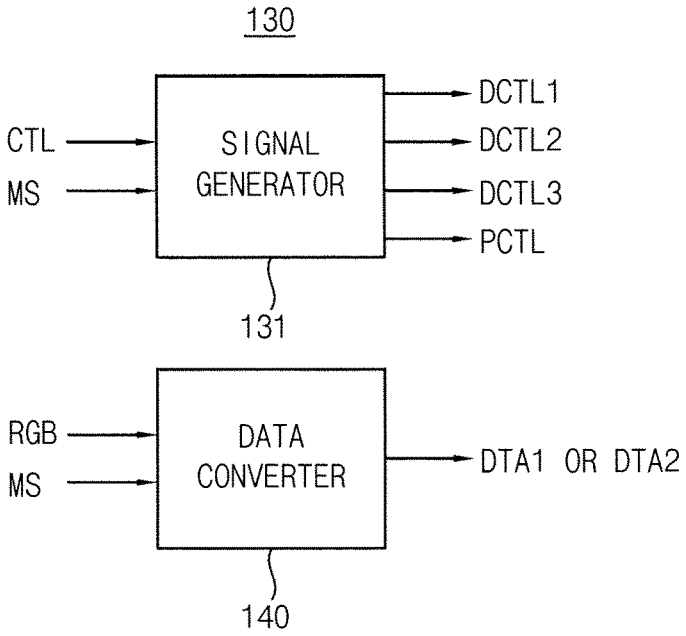
FIG. 4 is a block diagram illustrating the timing controller in the OLED display device of FIG. 1.

FIG. 4 is a block diagram illustrating the timing controller in the OLED display device of FIG. 1.

Referring to FIG. 4, the timing controller 130 may include a signal generator 131 and a data converter 140.

The signal generator 131 may generate the first driving control signal DCTL1 that controls the data driver 150, the second driving control signal DCTL2 that controls the scan driver 160, the third driving control signal DCTL3 that controls the emission driver 170 and the power control signal PCTL that controls the power supply 180, in response to the control signal CTL and the mode signal MS. The data converter 140 may convert the input image data RGB to the first display data DTA1 not including black data or may convert the input image data RGB to the second display data DTA2 including black data, based on the mode signal MS. The data converter 140 may provide the data driver 150 with the first display data DTA1 or the second display data DTA2 including the black data.

Figure 5:
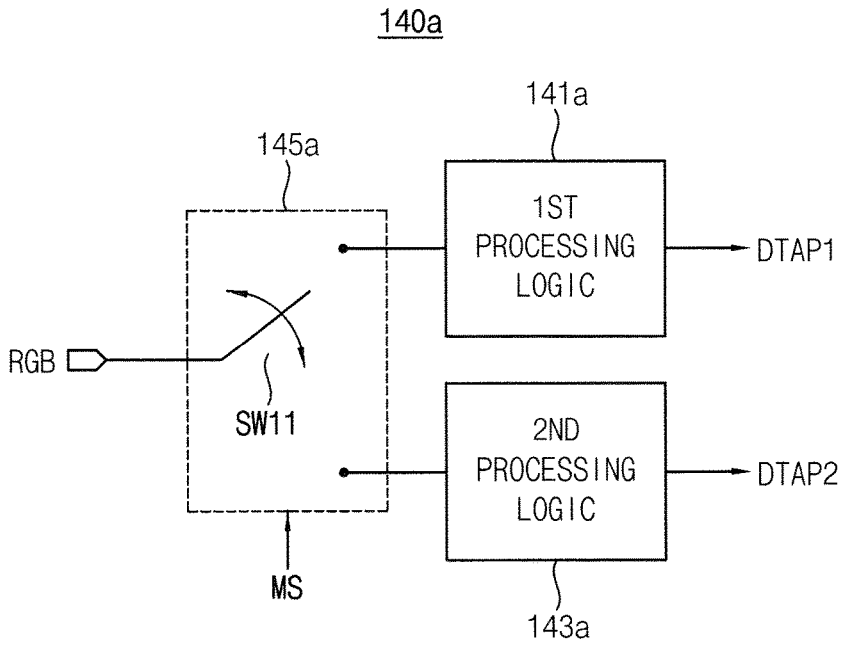
FIG. 5 is a block diagram illustrating an example of the data converter in the timing controller of FIG. 4.

FIG. 5 is a block diagram illustrating an example of the data converter in the timing controller of FIG. 4.

A data converter 140*a* of FIG. 5 may be employed in the data converter 140 in FIG. 4 when the display panel 110 is a pentile configuration as shown in FIG. 3.

Referring to FIG. 5, the data converter 140*a* may include a switching circuit 145*a*, a first processing logic 141*a* and a second processing logic 143*a*. The switching circuit 145*a* may determine a path of the input image data RGB to one of the first processing logic 141*a* and the second processing logic 143*a* in response to the mode signal MS. The switching circuit 145*a* may include a switch SW11 that switches in response to the mode signal MS.

When the mode signal MS directs the normal mode, the switch SW11 transfers the input image data RGB to the first processing logic 141*a*, and the first processing logic 141*a* processes the input image data RGB to provides the data driver 150 with a first display data DTAP1 which does not include the black data and conforms to a pentile configuration. When the mode signal MS directs the dimming mode, the switch SW11 transfers the input image data RGB to the first second logic 143*a*, and the second processing logic 143*a* processes the input image data RGB to provides the data driver 150 with a second display data DTAP2 which includes the black data and conforms to the pentile configuration.

Figure 6:
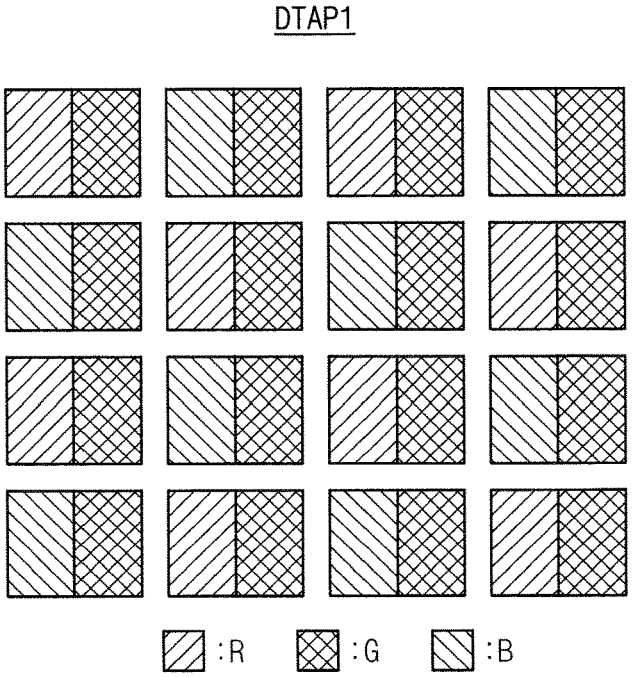
FIG. 6 illustrates an example of the first display data that the data converter of FIG. 5 provides to the data driver in the normal mode, according to some example embodiments of the present invention.

FIG. 6 illustrates an example of the first display data that the data converter of FIG. 5 provides to the data driver in the normal mode according to some example embodiments of the present invention.

Referring to FIGS. 3, 5 and 6, the first processing logic 141 a of the data converter 140*a* processes the input image data RGB to provide the data driver 150 with the first display data DTAP1 not including the black data such that each of the sub pixels SP11~SP13 of the display panel 110*a* having the pentile configuration in FIG. 3 emits light and the data driver 150 applies data voltages corresponding to the first display data DTAP1 to each of the sub pixels SP11~SP13 of the display panel 110*a*.

Figure 7:
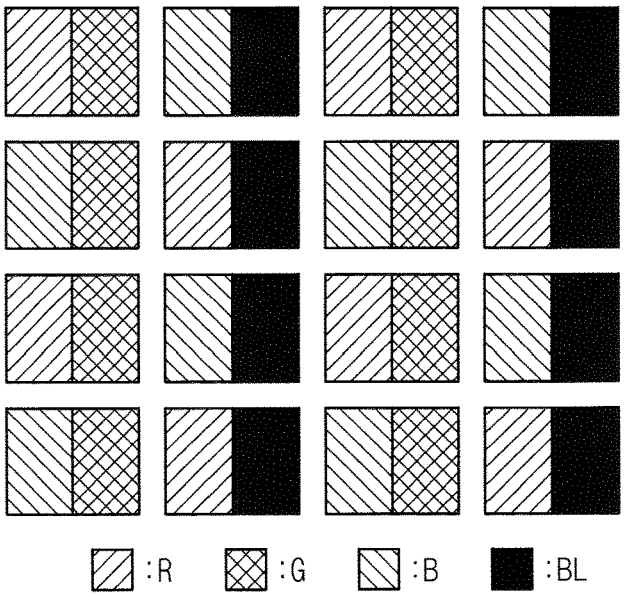
FIG. 7 illustrates an example of the second display data that the data converter of FIG. 5 provides to the data driver in the dimming mode, according to some example embodiments of the present invention.

FIG. 7 illustrates an example of the second display data that the data converter of FIG. 5 provides to the data driver in the dimming mode according to example embodiments.

Referring to FIGS. 3, 5 and 7, the second processing logic 143*a* of the data converter 140*a* processes the input image data RGB to provide the data driver 150 with the second display data DTAP2 including the black data such that some of the sub pixels SP11~SP13 of the display panel 110*a* having the pentile configuration in FIG. 3 do not emit light and the data driver 150 applies data voltages corresponding to the second display data DTAP2 to each of the sub pixels SP11~SP13 of the display panel 110*a*. The second processing logic 143*a* of the data converter 140*a* processes the input image data RGB and converts the input image data RGB to provide the second display data DTAP2 such that the second sub pixels SP12 of the second pixel PX12 and the fourth pixel PX14 include the black data in the dimming mode. As mentioned above, the second sub pixel SP12 emits a green color light, and the second sub pixel SP12 is included in each pixel in the display panel having the pentile configuration. Therefore, when the second display data DTAP2 of FIG. 7 is applied to the display panel 110*a*, visibility may not be greatly influenced.

Figure 8:
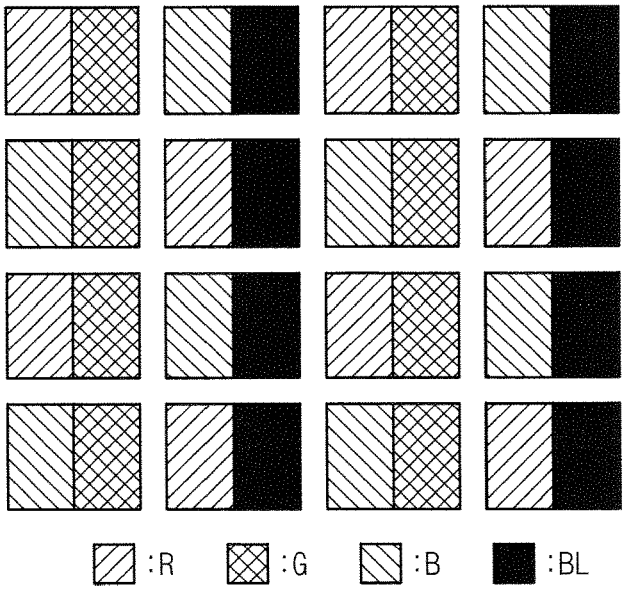
FIGS. 8 and 9 illustrate examples of the second display data that the data converter of FIG. 5 provides to the data driver in the dimming mode during consecutive two frames, according to some example embodiments of the present invention.
Figure 9:
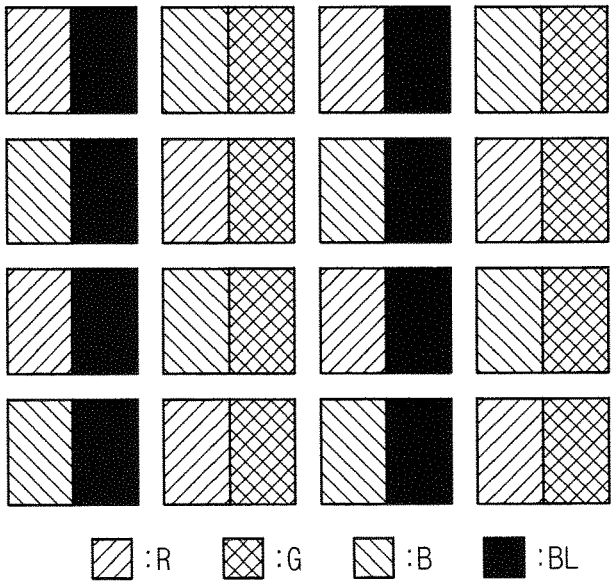

FIGS. 8 and 9 illustrate examples of the second display data that the data converter of FIG. 5 provides to the data driver in the dimming mode during consecutive two frames according to example embodiments.

Referring to FIGS. 3, 5, 8 and 9, the second processing logic 143*a* of the data converter 140*a* processes the input image data RGB to provide the data driver 150 with a second display data DTAP21_O including the black data during k-th frame period (k is an integer greater than one) and to provide the data driver 150 with a second display data DTAP21_E including the black data during (k+1)-th frame period such that some of the sub pixels SP11~SP13 of the display panel 110*a* having the pentile configuration in FIG. 3 do not emit light in the dimming mode. The second processing logic 143*a* of the data converter 140*a* processes the input image data RGB and converts the input image data RGB to provide the data driver 150 with the second display data DTAP21_O such that the second sub pixels SP12 of the second pixel PX12 and the fourth pixel PX14 include the black data during k-th frame period and to provide the data driver 150 with the second display data DTAP21_E such that the second sub pixels SP12 of the first pixel PX11 and the third pixel PX13 include the black data during (k+1)-th frame period in the dimming mode. As mentioned above, the second sub pixel SP12 emits a green color light, and the second sub pixel SP12 is included in each pixel in the display panel having the pentile configuration. Therefore, when the second display data DTAP21_O of FIG. 8 and DTAP21_E of FIG. 9 are applied to the display panel 110*a*, visibility may not be greatly influenced due to chopping phenomenon between the frames.

Figure 10:
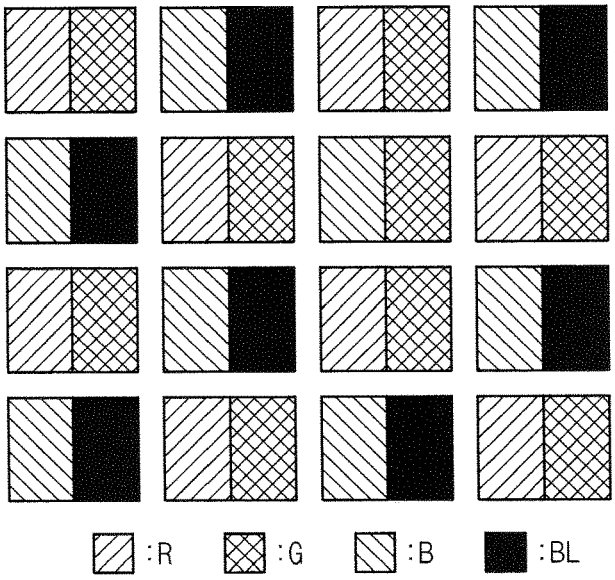
FIGS. 10 and 11 illustrate examples of the second display data that the data converter of FIG. 5 provides to the data driver in the dimming mode during consecutive two frames, according to some example embodiments of the present invention.
Figure 11:
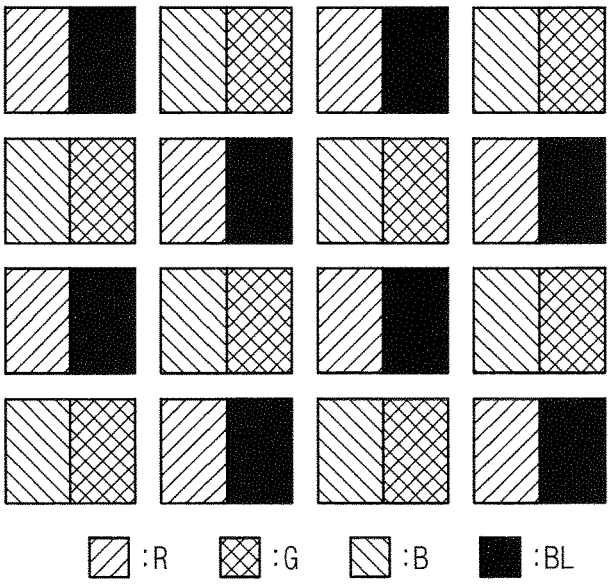

FIGS. 10 and 11 illustrate examples of the second display data that the data converter of FIG. 5 provides to the data driver in the dimming mode during consecutive two frames according to example embodiments.

Referring to FIGS. 3, 5, 10 and 11, the second processing logic 143*a* of the data converter 140*a* processes the input image data RGB to provide the data driver 150 with a second display data DTAP22_O including the black data during k-th frame period and to provide the data driver 150 with a second display data DTAP22_E including the black data during (k+1)-th frame period such that some of the sub pixels SP11~SP13 of the display panel 110*a* having the pentile configuration in FIG. 3 do not emit light in the dimming mode.

The second processing logic 143*a* of the data converter 140*a* processes the input image data RGB and converts the input image data RGB to provide the data driver 150 with the second display data DTAP22_O such that the second sub pixels SP12 of the second pixel PX12 and the third pixel PX13 include the black data during k-th frame period and to provide the data driver 150 with the second display data DTAP22_E such that the second sub pixels SP12 of the first pixel PX11 and the fourth pixel PX14 include the black data during (k+1)-th frame period in the dimming mode.

As mentioned above, the second sub pixel SP12 emits a green color light, and the second sub pixel SP12 is included in each pixel in the display panel having the pentile configuration. Therefore, when the second display data DTAP22_O of FIG. 10 and DTAP22_E of FIG. 11 are applied to the display panel 110*a*, visibility may not be greatly influenced due to chopping phenomenon between the frames.

Figure 12:
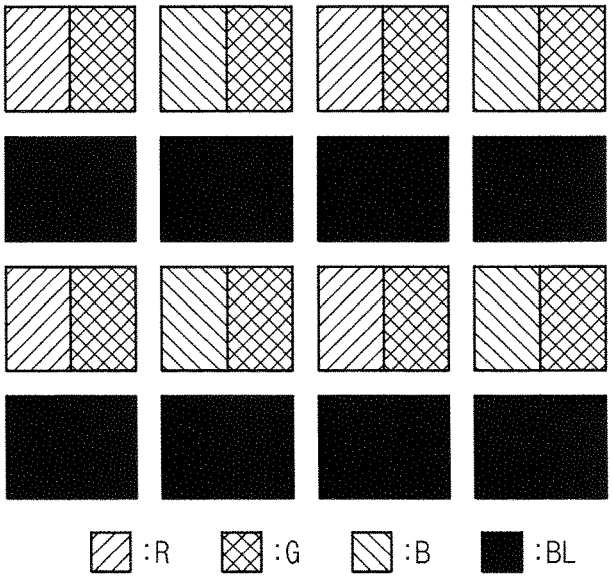
FIGS. 12 and 13 illustrate examples of the second display data that the data converter of FIG. 5 provides to the data driver in the dimming mode during consecutive two frames, according to some example embodiments of the present invention.
Figure 13:
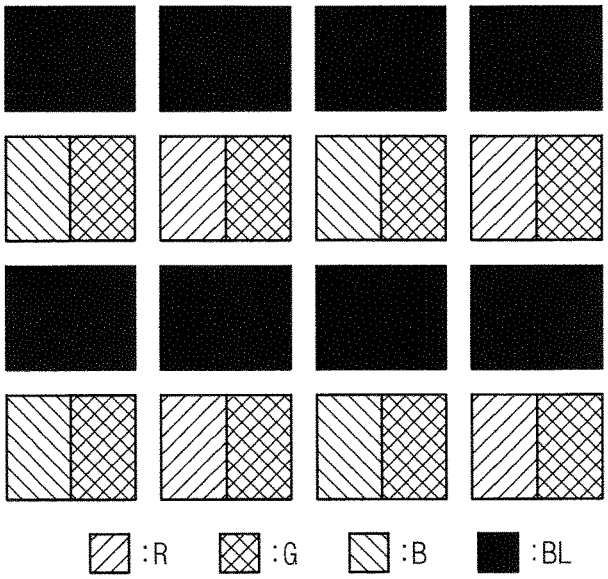

FIGS. 12 and 13 illustrate examples of the second display data that the data converter of FIG. 5 provides to the data driver in the dimming mode during consecutive two frames according to example embodiments.

Referring to FIGS. 3, 5, 12 and 13, the second processing logic 143*a* of the data converter 140*a* processes the input image data RGB to provide the data driver 150 with a second display data DTAP23_O including the black data during k-th frame period and to provide the data driver 150 with a second display data DTAP23_E including the black data during (k+1)-th frame period such that some of the sub pixels SP11~SP13 of the display panel 110*a* having the pentile configuration in FIG. 3 do not emit light in the dimming mode.

The second processing logic 143*a* of the data converter 140*a* processes the input image data RGB and converts the input image data RGB to provide the data driver 150 with the second display data DTAP23_O such that the all pixels in even-numbered pixel rows include the black data during k-th frame period and to provide the data driver 150 with the second display data DTAP23_E such that all pixels in the odd-numbered pixel rows include the black data during (k+1)-th frame period in the dimming mode.

As mentioned above, the second sub pixel SP12 emits a green color light, and the second sub pixel SP12 is included in each pixel in the display panel having the pentile configuration. Therefore, when the second display data DTAP23_O of FIG. 12 and DTAP23_E of FIG. 13 are applied to the display panel 110*a*, visibility may not be greatly influenced due to spatial and temporal dithering phenomenon between the frames.

Figure 14:
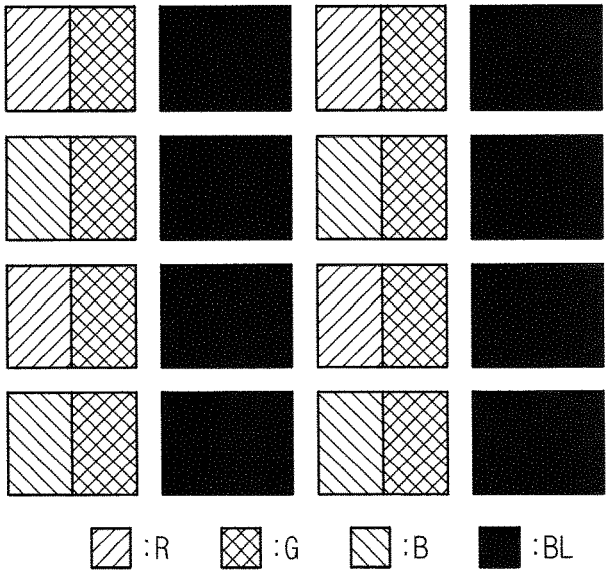
FIGS. 14 and 15 illustrate examples of the second display data that the data converter of FIG. 5 provides to the data driver in the dimming mode during consecutive two frames, according to some example embodiments of the present invention.
Figure 15:
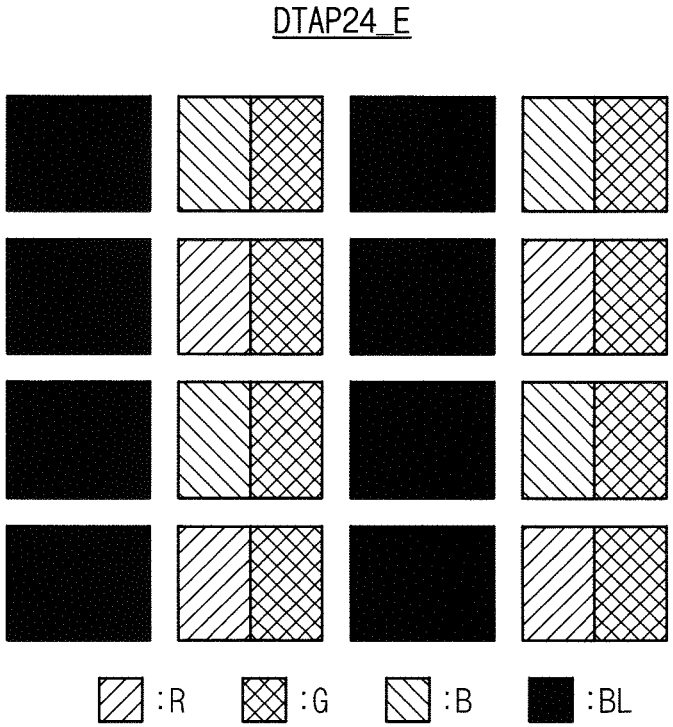

FIGS. 14 and 15 illustrate examples of the second display data that the data converter of FIG. 5 provides to the data driver in the dimming mode during consecutive two frames according to example embodiments.

Referring to FIGS. 3, 5, 14 and 15, the second processing logic 143*a* of the data converter 140*a* processes the input image data RGB to provide the data driver 150 with a second display data DTAP24_O including the black data during k-th frame period and to provide the data driver 150 with a second display data DTAP24_E including the black data during (k+1)-th frame period such that some of the sub pixels SP11~SP13 of the display panel 110*a* having the pentile configuration in FIG. 3 do not emit light in the dimming mode.

The second processing logic 143*a* of the data converter 140*a* processes the input image data RGB and converts the input image data RGB to provide the data driver 150 with the second display data DTAP24_O such that the second pixel PX12 and the fourth pixel PX14 include the black data during k-th frame period and to provide the data driver 150 with the second display data DTAP24_E such that the first pixel PX11 and the third pixel PX13 include the black data during (k+1)-th frame period in the dimming mode.

As mentioned above, the second sub pixel SP12 emits a green color light, and the second sub pixel SP12 is included in each pixel in the display panel having the pentile configuration. Therefore, when the second display data DTAP24_O of FIG. 14 and DTAP24_E of FIG. 15 are applied to the display panel 110*a*, visibility may not be greatly influenced due to spatial and temporal dithering phenomenon between the frames.

In FIGS. 6 through 15, R denotes a red color light, G denotes a green color light, B denotes a blue color light and BL denotes black data.

Figure 16:
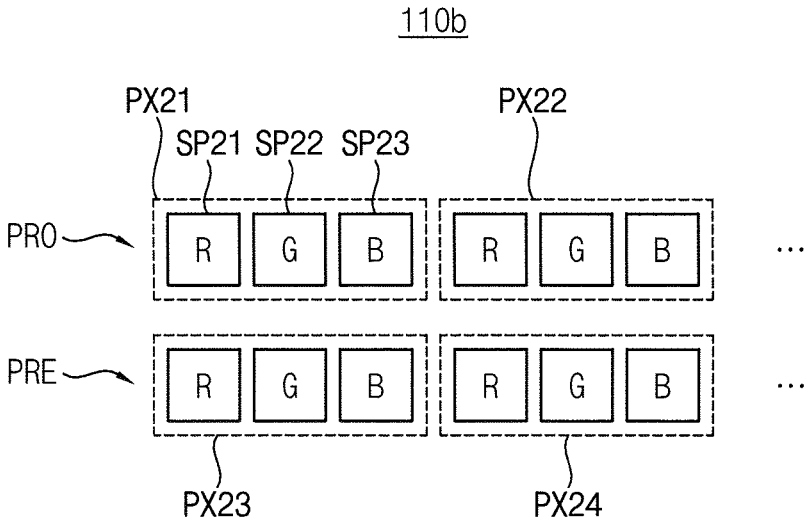
FIG. 16 illustrates another example of the display panel in the OLED display device of FIG. 1.

FIG. 16 illustrates another example of the display panel in the OLED display device of FIG. 1.

Referring to FIG. 16, a display panel 110*b* may include a plurality of odd-numbered pixel rows PRO and a plurality of even-numbered pixel rows PRE that are alternately arranged with respect to each other. Each of the odd-numbered pixel rows PRO may include first pixels PX21 and second pixels PX22 that are alternately arranged with respect to each other. Each of the even-numbered pixel rows may include third pixels PX23 and fourth pixels PX24 that are alternately arranged with respect to each other.

Each of the first through fourth pixels PX21~PX24 includes a first sub pixel SP21 emitting a first color light, a second sub pixel SP22 emitting a second color light and a third sub pixel SP23 emitting a third color light. In an embodiment, the first color light may be a red color light, the second color light may be a green color light and the third color light may be a blue color light. That is, the display panel 110*b* of FIG. 16 may be a real-stripe configuration.

Figure 17:
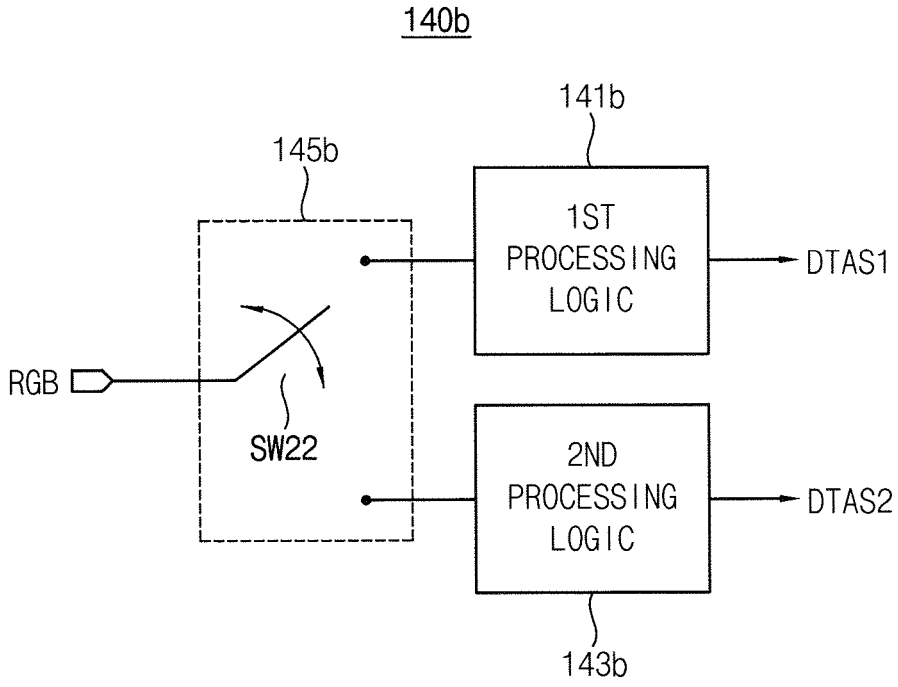
FIG. 17 is a block diagram illustrating another example of the data converter in the timing controller of FIG. 4.

FIG. 17 is a block diagram illustrating another example of the data converter in the timing controller of FIG. 4.

A data converter 140*b* of FIG. 17 may be employed in the data converter 140 in FIG. 4 when the display panel 110 is a real-stripe configuration as shown in FIG. 16.

Referring to FIG. 17, the data converter 140*b* may include a switching circuit 145*b*, a first processing logic 141*b* and a second processing logic 143*b*. The switching circuit 145*b* may determine a path of the input image data RGB to one of the first processing logic 141*b* and the second processing logic 143*b* in response to the mode signal MS. The switching circuit 145*b* may include a switch SW22 that switches in response to the mode signal MS.

When the mode signal MS directs the normal mode, the switch SW22 transfers the input image data RGB to the first processing logic 141*b*, and the first processing logic 141*b* processes the input image data RGB to provides the data driver 150 with a first display data DTAS1 which does not include the black data and conforms to a real-stripe configuration. When the mode signal MS directs the dimming mode, the switch SW22 transfers the input image data RGB to the first second logic 143*b*, and the second processing logic 143*b* processes the input image data RGB to provides the data driver 150 with a second display data DTAS2 which includes the black data and conforms to the real-stripe configuration.

Figure 18:
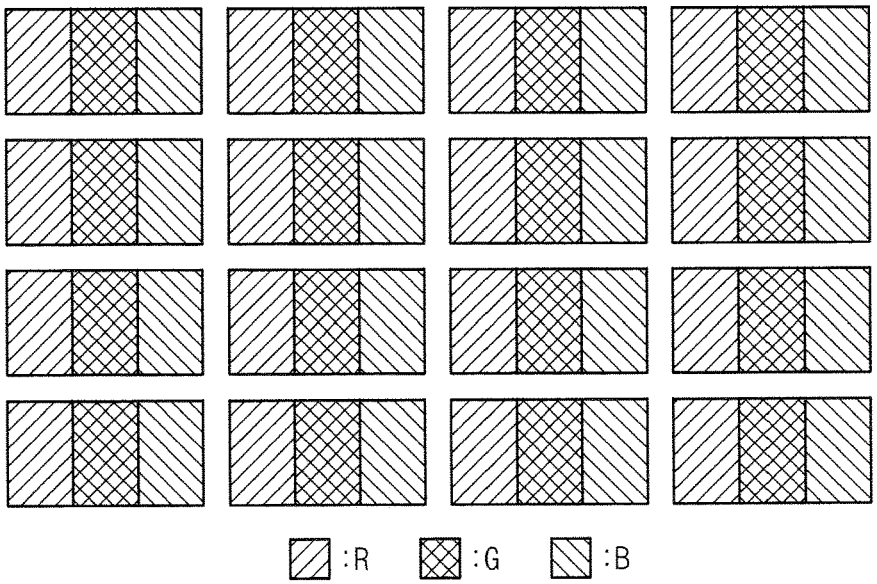
FIG. 18 illustrates an example of the first display data that the data converter of FIG. 17 provides to the data driver in the normal mode, according to some example embodiments of the present invention.

FIG. 18 illustrates an example of the first display data that the data converter of FIG. 17 provides to the data driver in the normal mode according to example embodiments.

Referring to FIGS. 16 through 18, the first processing logic 141*b* of the data converter 140*b* processes the input image data RGB to provide the data driver 150 with the first display data DTAS1 not including the black data such that each of the sub pixels SP21~SP23 of the display panel 110*b* having the real-stripe configuration in FIG. 16 emits light and the data driver 150 applies data voltages corresponding to the first display data DTAS1 to each of the sub pixels SP21~SP23 of the display panel 110*b*.

FIGS. 19 and 20, FIGS. 21 and 22, FIGS. 23 and 24, FIGS. 25 and 26, FIGS. 27 and 28 and FIGS. 29 and 30 respectively illustrate examples of the second display data that the data converter of FIG. 17 provides to the data driver in the dimming mode during consecutive two frames according to example embodiments.

Referring to FIGS. 16, 17, and 19 through 20, the second processing logic 143*b* of the data converter 140*b* processes the input image data RGB to provide the data driver 150 with one of second display data DTAS21_O, DTAS22_O, DTAS23_O, DTAS24_O, DTAS25_O and DTAS26_O, each including the black data during k-th frame period and to provide the data driver 150 with corresponding one of second display data DTAS21_E, DTAS22_E, DTAS23_E, DTAS24_E, DTAS25_E and DTAS26_E, each including the black data during (k+1)-th frame period such that some of the sub pixels SP21~SP23 of the display panel 110*b* having the real-stripe configuration in FIG. 16 do not emit light in the dimming mode.

The second processing logic 143*b* of the data converter 140*b* processes the input image data RGB and converts the input image data RGB to provide the data driver 150 with one of second display data DTAS21_O, DTAS22_O, DTAS23_O, DTAS24_O, DTAS25_O and DTAS26_O such that one same sub pixel of the sub pixels SP21~SP23 of the first pixel PX21 and the third pixel PX23 or one same sub pixel of the sub pixels SP21~SP23 of the first pixel PX21 and the fourth pixel PX24 includes the black data during k-th frame period and to provide the data driver 150 with the corresponding one of second display data DTAS21_E, DTAS22_E, DTAS23_E, DTAS24_E, DTAS25_E and DTAS26_E such that one same sub pixel of the sub pixels SP21~SP23 of the second pixel PX22 and the fourth pixel PX24 or one same sub pixel of the sub pixels SP21~SP23 of the second pixel PX22 and the includes pixel PX24 includes the black data during (k+1)-th frame period in the dimming mode. When the second display data DTAS21_O~DTAS26_O and DTAS21_E~DTAS26_E of FIGS. 19 through 20 are applied to the display panel 110*b*, visibility may not be greatly influenced due to chopping phenomenon between the frames.

The one same sub pixel may be one of the third sub pixel SP23 emitting a third color light, the second sub pixel SP22 emitting a second color light and the first sub pixel SP21 emitting a first color light.

Figure 19:
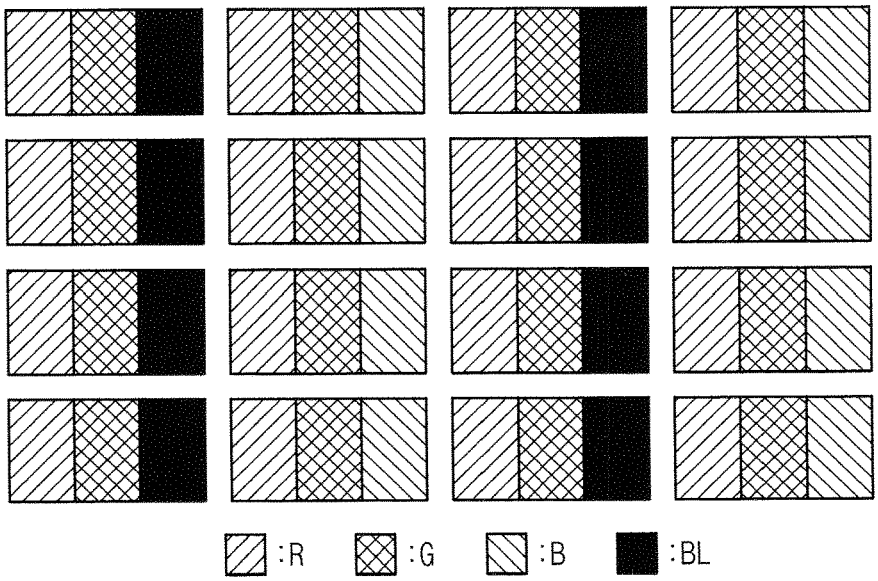
FIGS. 19 and 20, FIGS. 21 and 22, FIGS. 23 and 24, FIGS. 25 and 26, FIGS. 27 and 28 and FIGS. 29 and 30 respectively illustrate examples of the second display data that the data converter of FIG. 17 provides to the data driver in the dimming mode during consecutive two frames, according to some example embodiments of the present invention.
Figure 20:
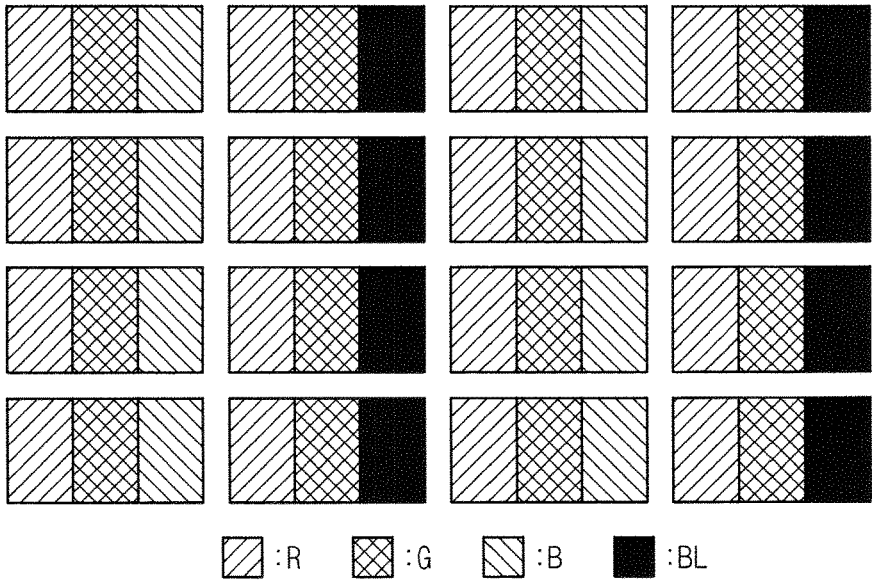

Referring to FIGS. 19 and 20, the second processing logic 143*b* of the data converter 140*b* processes the input image data RGB and converts the input image data RGB to provide the data driver 150 with the second display data DTAS21_O such that the third sub pixels SP23 of the first pixel PX21 and the third pixel PX23 include the black data during k-th frame period and to provide the data driver 150 with the second display data DTAS21_E such that the third sub pixels SP23 of the second pixel PX22 and the fourth pixel PX24 include the black data during (k+1-th) frame period in the dimming mode.

Figure 21:
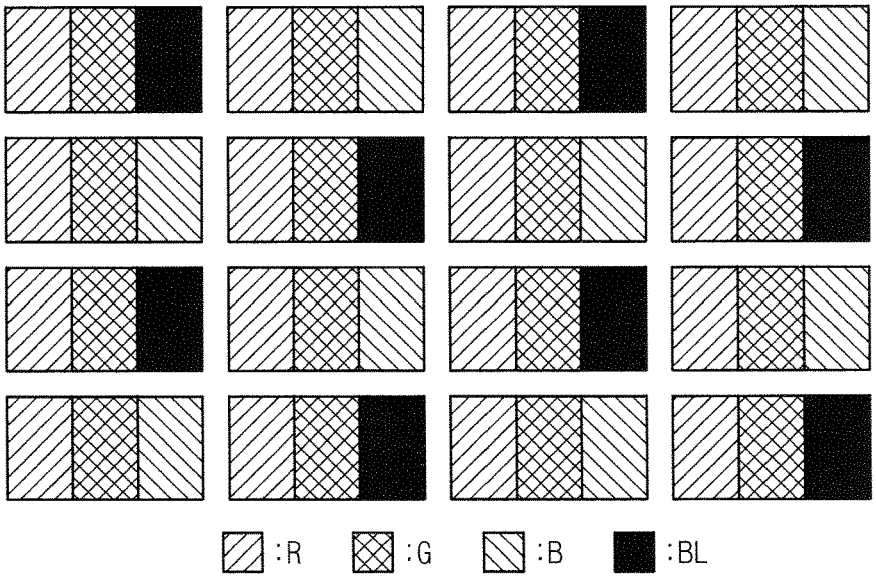
Figure 22:
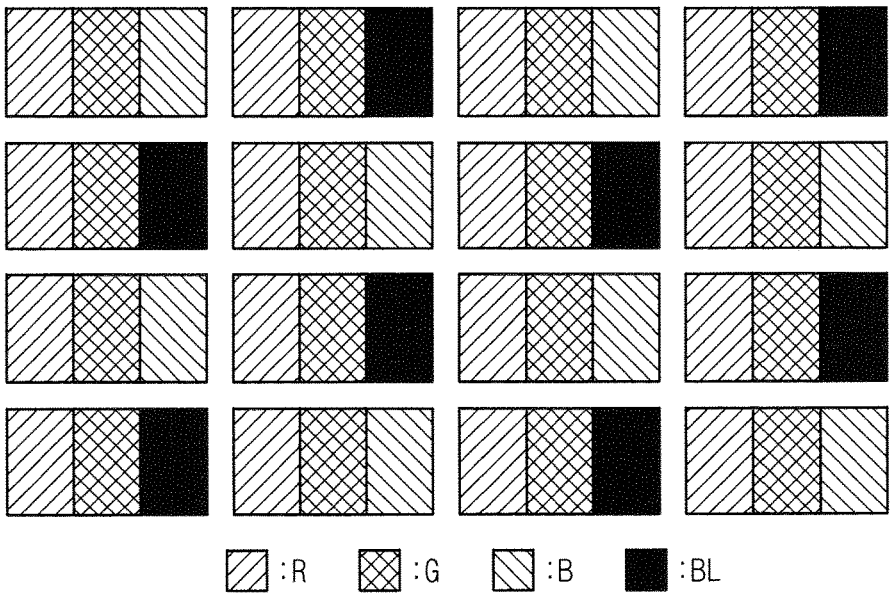

Referring to FIGS. 21 and 22, the second processing logic 143*b* of the data converter 140*b* processes the input image data RGB and converts the input image data RGB to provide the data driver 150 with the second display data DTAS22_O such that the third sub pixels SP23 of the first pixel PX21 and the fourth pixel PX24 include the black data during k-th frame period and to provide the data driver 150 with the second display data DTAS22_E such that the third sub pixels SP23 of the second pixel PX22 and the third pixel PX23 include the black data during (k+1)-th frame period in the dimming mode.

Figure 23:
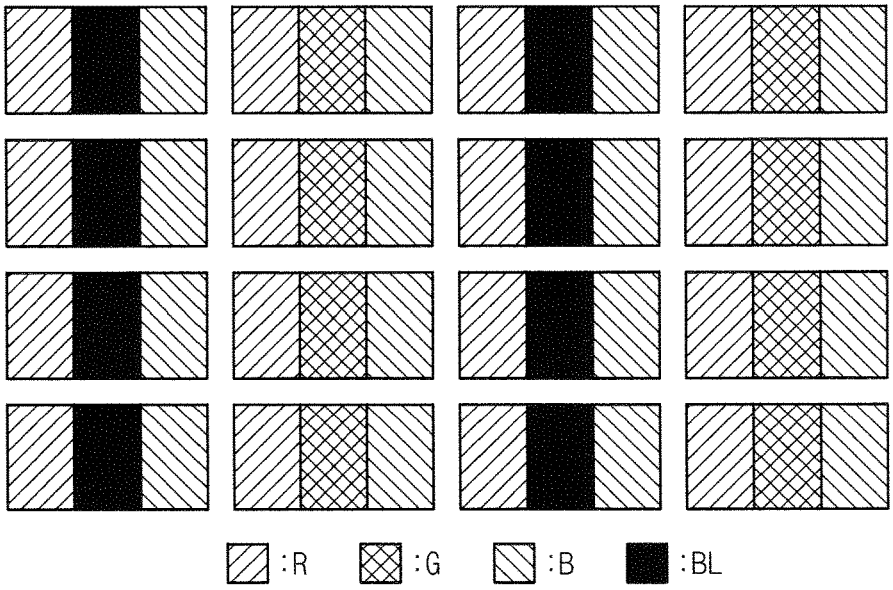
Figure 24:
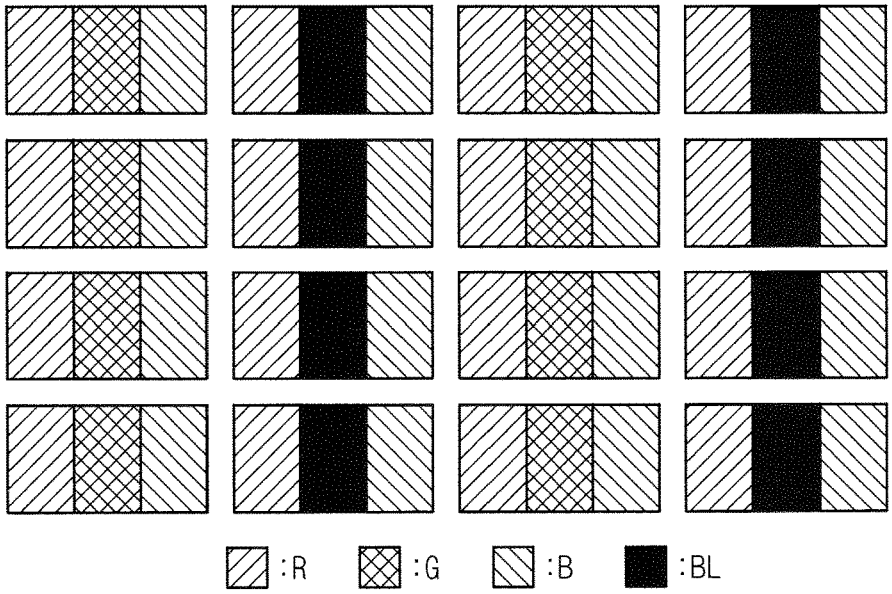

Referring to FIGS. 23 and 24, the second processing logic 143*b* of the data converter 140*b* processes the input image data RGB and converts the input image data RGB to provide the data driver 150 with the second display data DTAS23_O such that the second sub pixels SP22 of the first pixel PX21 and the third pixel PX23 include the black data during k-th frame period and to provide the data driver 150 with the second display data DTAS23_E such that the second sub pixels SP22 of the second pixel PX22 and the fourth pixel PX24 include the black data during (k+1)-th frame period in the dimming mode.

Figure 25:
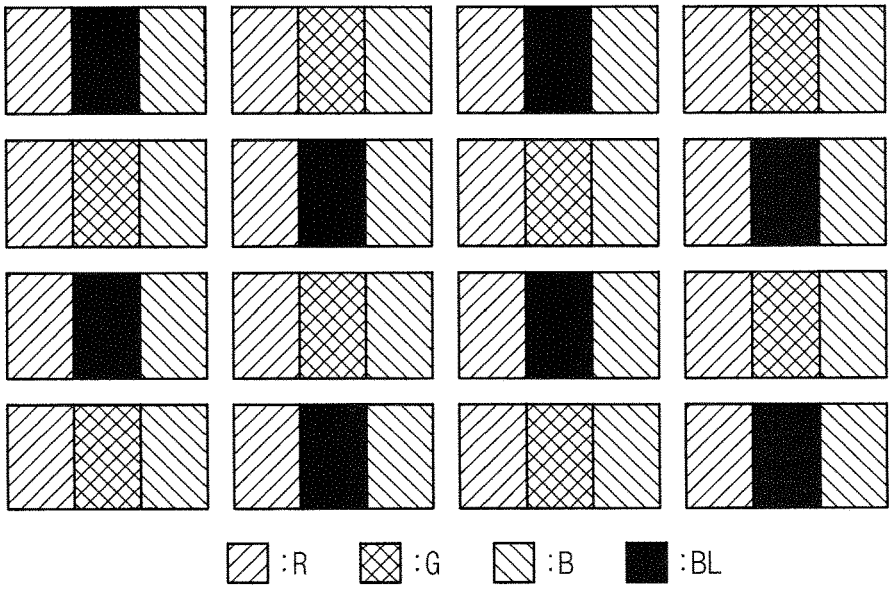
Figure 26:
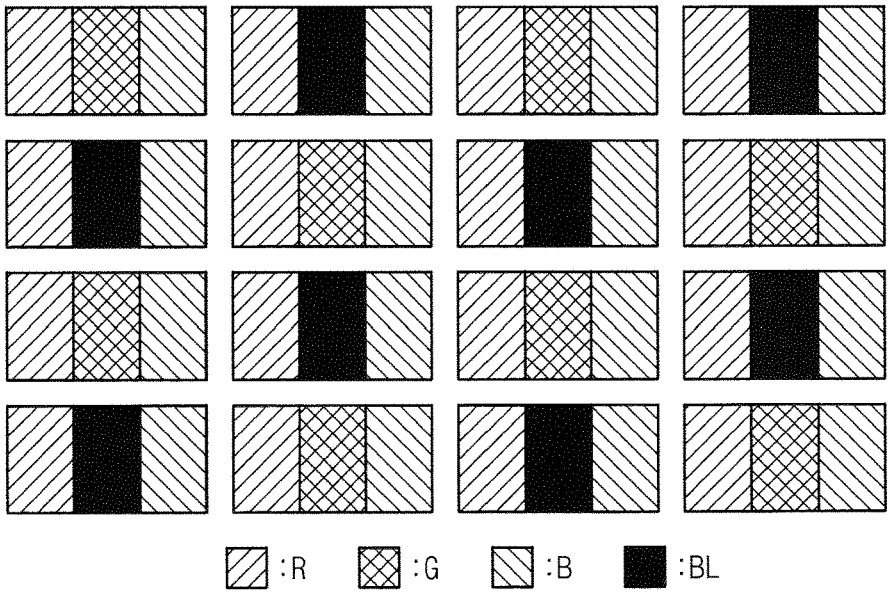

Referring to FIGS. 25 and 26, the second processing logic 143*b* of the data converter 140*b* processes the input image data RGB and converts the input image data RGB to provide the data driver 150 with the second display data DTAS24_O such that the second sub pixels SP22 of the first pixel PX21 and the fourth pixel PX24 include the black data during k-th frame period and to provide the data driver 150 with the second display data DTAS24_E such that the second sub pixels SP22 of the second pixel PX22 and the third pixel PX23 include the black data during (k+1)-th frame period in the dimming mode.

Figure 27:
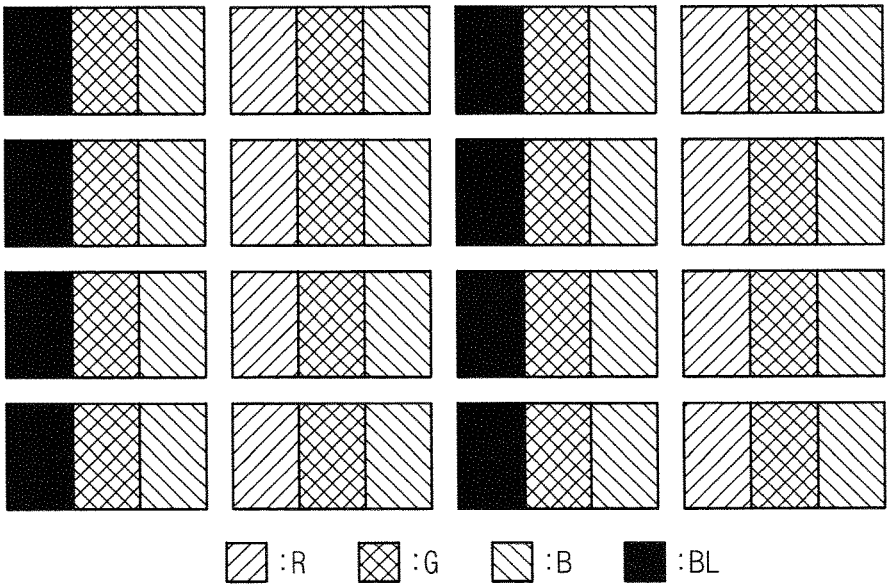
Figure 28:
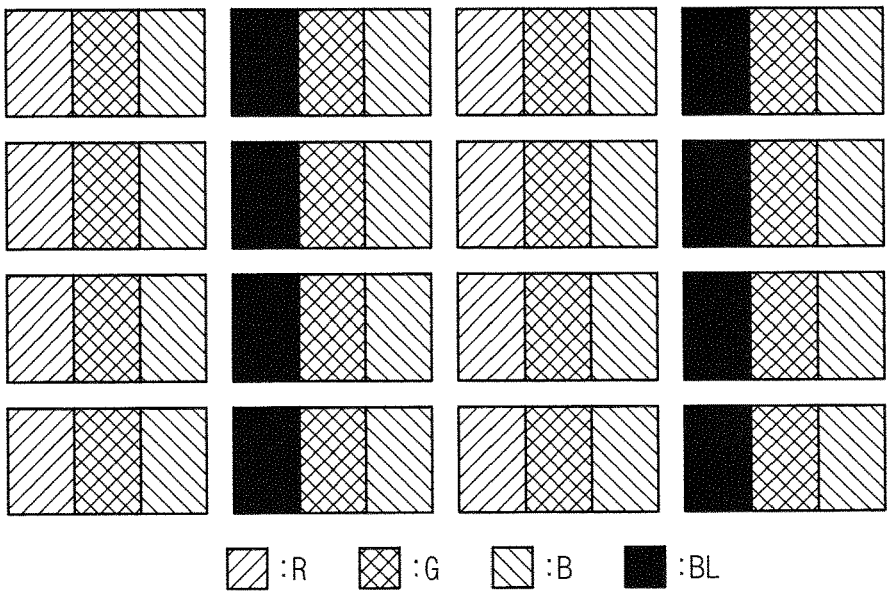

Referring to FIGS. 27 and 28, the second processing logic 143*b* of the data converter 140*b* processes the input image data RGB and converts the input image data RGB to provide the data driver 150 with the second display data DTAS25_O such that the first sub pixels SP21 of the first pixel PX21 and the third pixel PX23 include the black data during k-th frame period and to provide the data driver 150 with the second display data DTAS25_E such that the first sub pixels SP21 of the second pixel PX22 and the fourth pixel PX24 include the black data during (k+1)-th frame period in the dimming mode.

Figure 29:
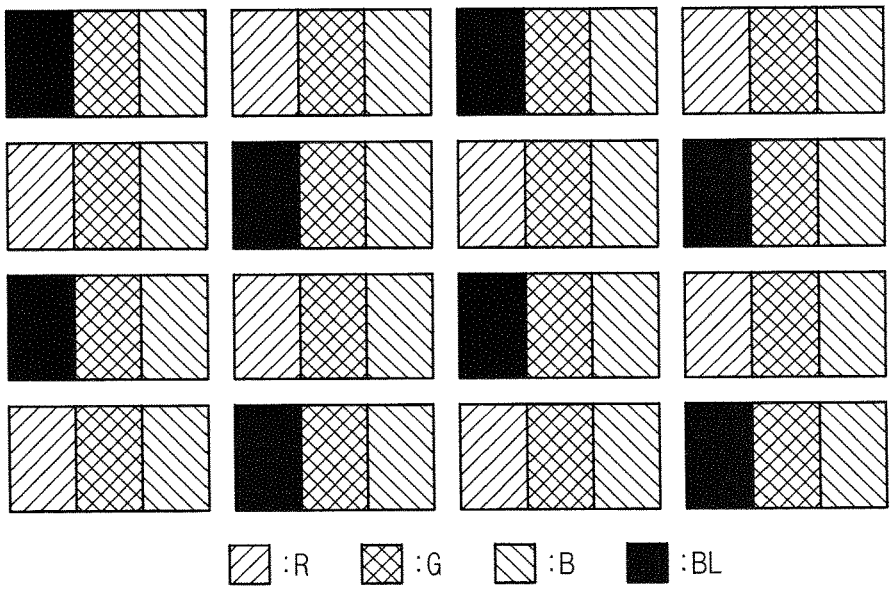
Figure 30:
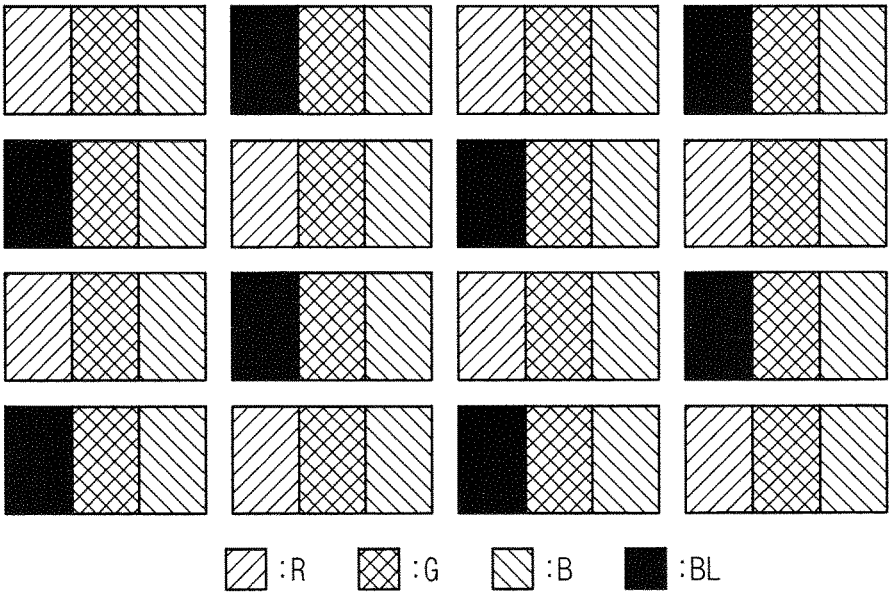

Referring to FIGS. 29 and 30, the second processing logic 143*b* of the data converter 140*b* processes the input image data RGB and converts the input image data RGB to provide the data driver 150 with the second display data DTAS26_O such that the first sub pixels SP21 of the first pixel PX21 and the fourth pixel PX24 include the black data during k-th frame period and to provide the data driver 150 with the second display data DTAS26_E such that the first sub pixels SP21 of the second pixel PX22 and the third pixel PX23 include the black data during (k+1)-th frame period in the dimming mode.

Figure 31:
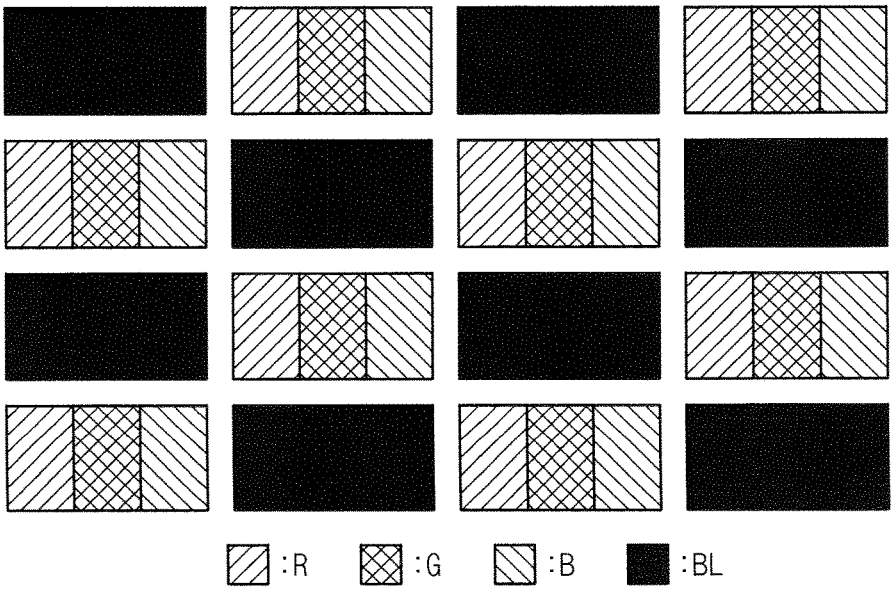
FIGS. 31 and 32 illustrate examples of the second display data that the data converter of FIG. 17 provides to the data driver in the dimming mode during consecutive two frames, according to some example embodiments of the present invention.
Figure 32:
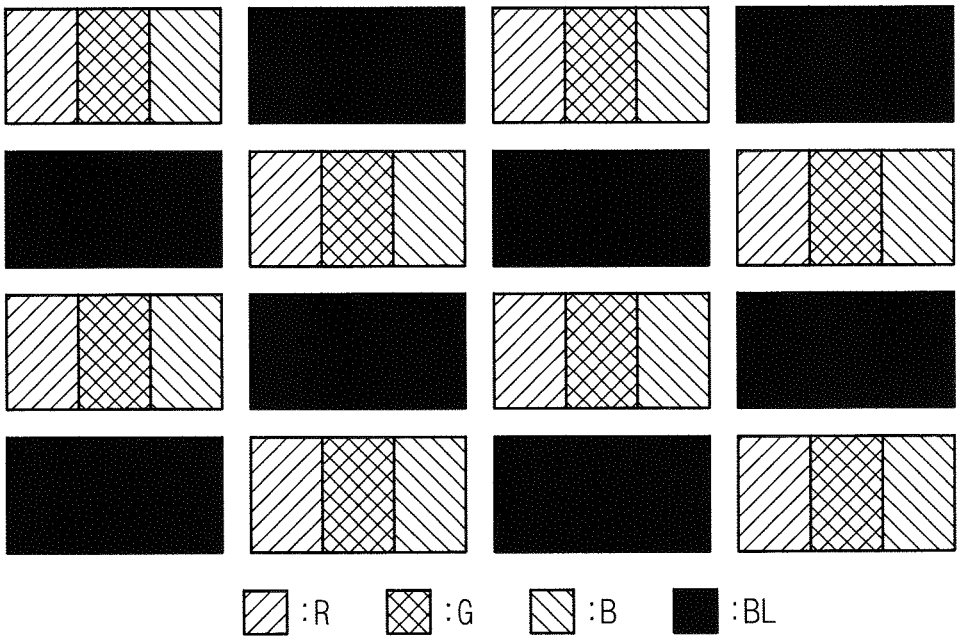

FIGS. 31 and 32 illustrate examples of the second display data that the data converter of FIG. 17 provides to the data driver in the dimming mode during consecutive two frames according to example embodiments.

Referring to FIGS. 16, 17, 31 and 32, the second processing logic 143*b* of the data converter 140*b* processes the input image data RGB to provide the data driver 150 with a second display data DTAS27_O including the black data during k-th frame period and to provide the data driver 150 with a second display data DTAS27_E including the black data during (k+1)-th frame period such that some of the sub pixels SP21~SP23 of the display panel 110*b* having the real-stripe configuration in FIG. 16 do not emit light in the dimming mode.

The second processing logic 143*b* of the data converter 140*b* processes the input image data RGB and converts the input image data RGB to provide the data driver 150 with the second display data DTAS27_O such that the first pixels PX21 and the fourth pixels PX24 include the black data during k-th frame period and to provide the data driver 150 with the second display data DTAS27_E such that the second pixels PX22 and the third pixels PX23 include the black data during (k+1)-th frame period in the dimming mode.

When the second display data DTAP27_O of FIG. 31 and DTAP27_E of FIG. 32 are applied to the display panel 110*b*, visibility may not be greatly influenced due to spatial and temporal dithering phenomenon between the frames.

In FIGS. 19 through 32, R denotes a red color light, G denotes a green color light, B denotes a blue color light and BL denotes black data.

Figure 33:
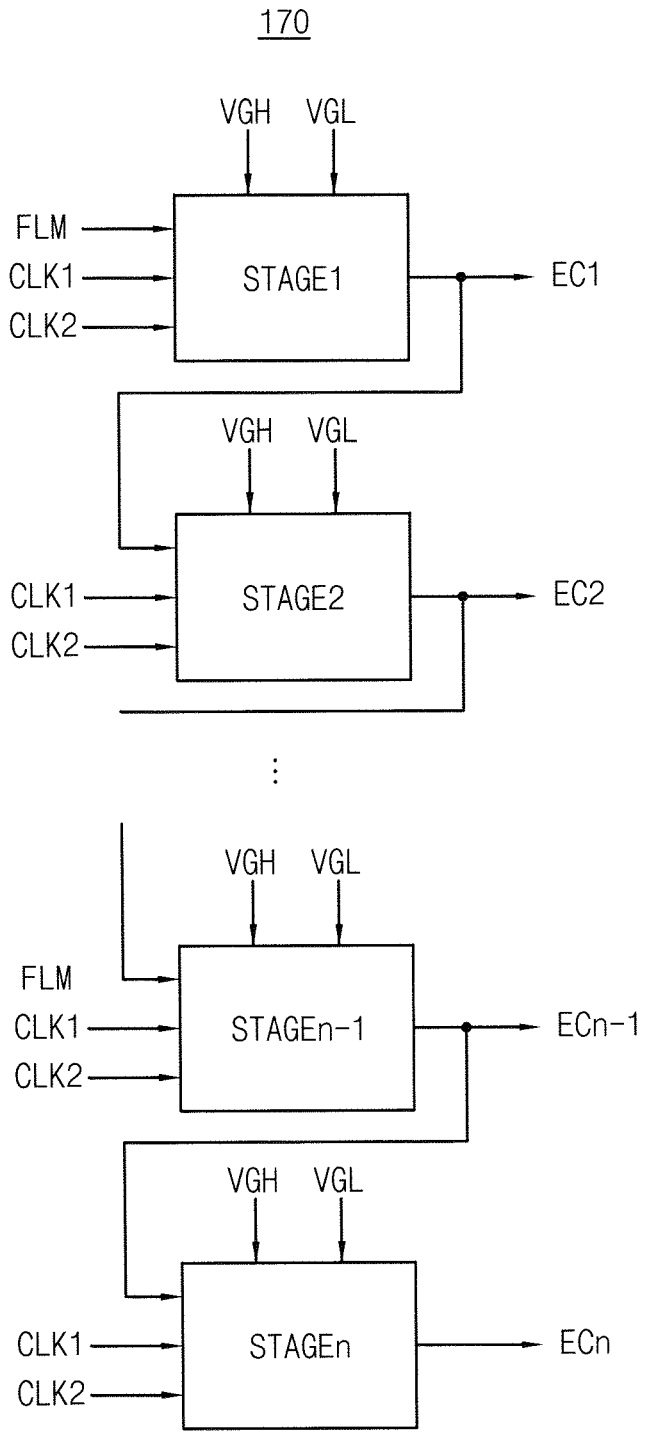
FIG. 33 is a block diagram illustrating the emission driver shown in the OLED display device of FIG. 1.

FIG. 33 is a block diagram illustrating the emission driver shown in the OLED display device of FIG. 1.

Referring to FIG. 1, the emission driver 170 may include a plurality of stages STAGE1~STAGEn connected to each other one after another to sequentially output the emission control signals EC1~ECn.

The stages STAGE1~STAGEn are connected to the emission control lines EL1~ELn, respectively, and sequentially output the emission control signals EC1~ECn. The emission control signals EC1~ECn overlap each other during a predetermined period.

Each of the stages STAGE1~STAGEn receives the first voltage VGL and the second voltage VGH having the voltage level higher than that of the first voltage VGL. In addition, each of the stages STAGE1~STAGEn receives the first clock signal CLK1 and the second clock signal CLK2. Hereinafter, the emission control signals EC1~EC2 output through the emission control lines EL1~ELn are referred to as first to n-th emission control signals.

Among the stages STAGE1~STAGEn, a first stage STAGE1 is driven in response to the start signal FLM. In detail, the first stage STAGE1 receives the first voltage VGL and the second voltage VGH and generates the first emission control signal EC1 in response to the start signal FLM, the first clock signal CLK1, and the second clock signal CLK2. The first emission control signal EC1 is applied to the pixels in the pixel row through the first emission control line EL1.

The stages STAGE2~STAGEn are connected to each other one after another and are sequentially driven. In detail, a present stage is connected to an output terminal of a pervious stage and receives the emission control signal output from the previous stage. The present stage is driven in response to the emission control signal provided from the previous stage.

For example, a second stage STAGE2 may receive the first emission control signal EC1 output from the first stage STAGE1 and is driven in response to the first emission control signal EC1. The second stage STAGE2 receives the first voltage VGL and the second voltage VGH and generates the second emission control signal EC2 in response to the first emission control signal Ec1, the first clock signal CLK1, and the second clock signal CLK2. The second emission control signal EC2 is applied to the pixels in the pixel row through the second emission control line EL2. The other stages STAGE3 to STAGEn are driven in the same way as the second stage STAGE2, and thus some details thereof will not be repeated.

Figure 34:
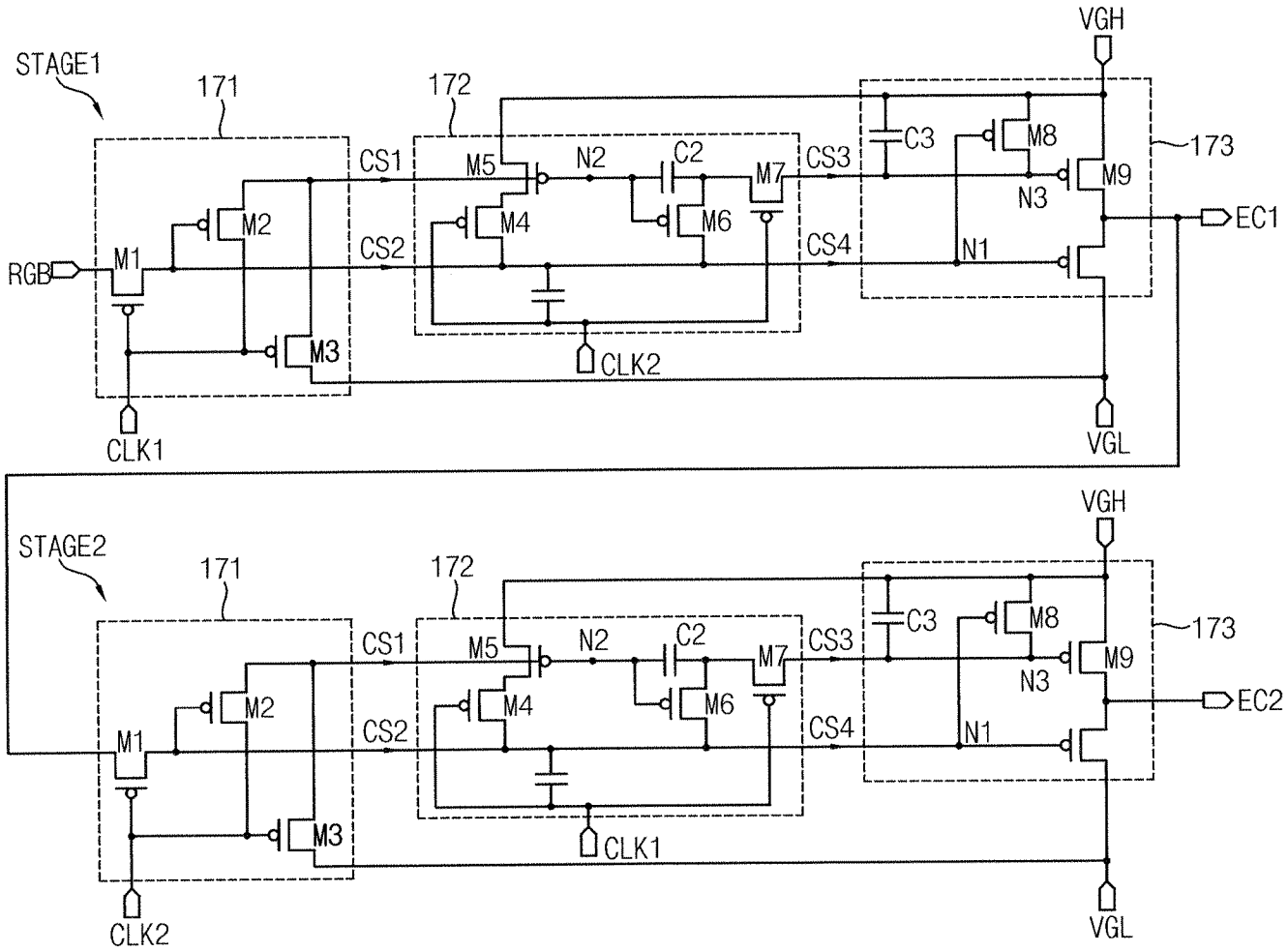
FIG. 34 is a circuit diagram illustrating the stages of the emission driver in FIG. 33, according to some example embodiments of the present invention.

FIG. 34 is a circuit diagram illustrating the stages of the emission driver in FIG. 33 according to example embodiments.

FIG. 34 shows the circuit diagram of the first stage STAGE1 and the second stage STAGE2, but the stages STAGE1 to STAGEn have the same circuit configuration and function. Thus, hereinafter, the circuit configuration and the operation of the first stage STAGE1 will be described in detail, and the circuit configuration and some aspects of the operation of the other stages STAGE2~STAGEn will not be repeated in order to avoid redundancy.

Referring to FIG. 34, each of the stages STAGE1~STAGEn may include a first signal processor 171, a second signal processor 172, and a third signal processor 173.

The first signal processor 171 of each of the stages STAGE1~STAGEn is applied with a first sub-control signal and a second sub-control signal. The first signal processor 171 of each of the stages STAGE2~STAGEn receives the emission control signal output from the previous stage as the first sub-control signal. The first signal processor 171 of the first stage STAGE1 receives the start signal FLM as the first sub-control signal. In addition, the first signal processor 171 of each of odd-numbered stages STAGE1, STAGE3, . . . , and STAGEn−1 receives the first clock signal CLK1 as the second sub-control signal. The first signal processor 171 of each of even-numbered stages STAGE2, STAGE4, . . . , and STAGEn receives the second clock signal CLK2 as the second sub-control signal.

Accordingly, the first signal processor 171 receives the first voltage VGL and generates a first signal CS1 and a second signal CS2 in response to the first and second sub-control signals. The first signal CS1 and the second signal CS2 are applied to the second signal processor 172. The first signal processor 171 of the first stage STAGE1 receives the first voltage VGL and generates the first signal CS1 and the second signal CS2 in response to the start signal FLM and the first clock signal CLK1. The first signal processor 171 applies the first signal CS1 and the second signal CS2 to the second signal processor 172. The first signal processor 151 may include first, second, third transistors M1, M2, and M3. The first, second, and third transistors M1, M2, and M3 may be p-channel metal oxide semiconductor (PMOS) transistors.

The first transistor M1 has a source terminal applied with the start signal FLM, a gate terminal applied with the first clock signal CLK1, and a drain terminal connected to a gate terminal of the second transistor M2. The second transistor M2 has the gate terminal connected to the drain terminal of the first transistor M1, a source terminal connected to a source terminal of the third transistor M3, and a drain has applied with the first clock signal CLK1. The third transistor M3 has a gate terminal applied with the first clock signal CLK1 and connected to the drain terminal of the second transistor M2, a source terminal connected to the source terminal of the second transistor M2, and a drain terminal applied with the first voltage VGL.

The first signal CS1 is output from the source terminals of the second and third transistors M2 and M2, which are connected to each other. The second signal CS2 is output from the drain terminal of the first transistor M1.

The second signal processor 172 of each of the stages STAGE1~STAGEn is applied with a third sub-control signal. The second signal processor 172 of each of the odd-numbered stages STAGE1, STAGE3, . . . , and STAGEn−1 receives the second clock signal CLK2 as the third sub-control signal. The second signal processor 172 of each of the even-numbered stages STAGE2, STAGE4, . . . , and STAGEn receives the first clock signal CLK1 as the third sub-control signal. The second signal processor 172 receives the second voltage VGH and generates a third signal CS3 and a fourth signal CS4 in response to the third sub-control signal, the first signal CS1, and the second signal CS3. The third signal CS3 and the fourth signal CS4 are applied to the second signal processor 172.

The second signal processor 172 of the first stage STAGE1 receives the second voltage VGH and generates the third signal CS3 and the fourth signal CS4 in response to the first and second signals CS1 and CS2 from the first signal processor 151 and the second clock signal CLK2. The second signal processor 172 applies the third signal CS3 and the fourth signal CS4 to the third signal processor 173. The second signal processor 152 may include fourth, fifth, sixth, and seventh transistors M4, M5, M6, and M7 and first and second capacitors C1 and C2. The fourth to seventh transistors M4 to M7 may be PMOS transistors.

The fourth transistor M4 has a gate terminal applied with the second clock signal CLK2, a drain terminal connected to a first node N1 and the gate terminal of the second transistor M2, and a source terminal connected to a drain terminal of the fifth transistor M5. The first capacitor C1 has a first electrode applied with the second clock signal CLK2 and a second electrode connected to the drain terminal of the fourth transistor M4 and the first node N1. The fifth transistor M5 has a gate terminal connected to the source terminal of the third transistor M3 and a second node N2, a source terminal applied with the second voltage VGH, and a drain terminal connected to the source terminal of the fourth transistor M4. The sixth transistor M6 has a gate terminal connected to the second node N2, a source terminal connected to a drain terminal of the seventh transistor M7, and a drain terminal applied with the second clock signal CLK2. The second capacitor C2 has a first electrode connected to the gate terminal of the sixth transistor M6 and a second electrode connected to the source terminal of the sixth transistor M6. The seventh transistor M7 has a gate terminal applied with the second clock signal CLK2, a source terminal connected to a third node N3, and the drain terminal connected to the source terminal of the sixth transistor M6.

The third signal CS3 is applied to the third node N3 and the fourth signal CS4 is applied to the first node N1. The third signal processor 153 of the first stage STAGE1 receives the first voltage VGL and the second voltage VGH, and generates the first emission control signal in response to the third signal CS3 and the fourth signal CS4 provided from the second signal processor 152. The first emission control signal is applied to the pixels through the first emission control line E1. The first emission control signal is applied to the first signal processor 151 of the second stage STAGE2.

The third signal processor 153 includes eighth, ninth, and tenth transistors M8, M9, and M10 and a third capacitor C3. The eighth, ninth, and tenth transistors M8, M9, and M10 are PMOS transistors.

The eighth transistor M8 has a gate terminal connected to the first node N1, a source terminal applied with the second voltage VGH, and a drain electrode connected to the third node N3. The third capacitor C3 has a first electrode applied with the second voltage VGH and a second electrode connected to the third node N3. The ninth transistor M9 has a gate terminal connected to the third node N3, a source terminal applied with the second voltage VGH, and a drain terminal connected to the first emission control line EC1. The tenth transistor M10 has a gate terminal connected to the first node N1, a source terminal connected to the first emission control line EC1, and a drain terminal applied with the first voltage VGL. The drain terminal of the ninth transistor M9 and the source terminal of the tenth transistor M10 are connected to the source terminal of the first transistor M1 of the first signal processor 171 of the second stage STAGE2.

Figure 35:
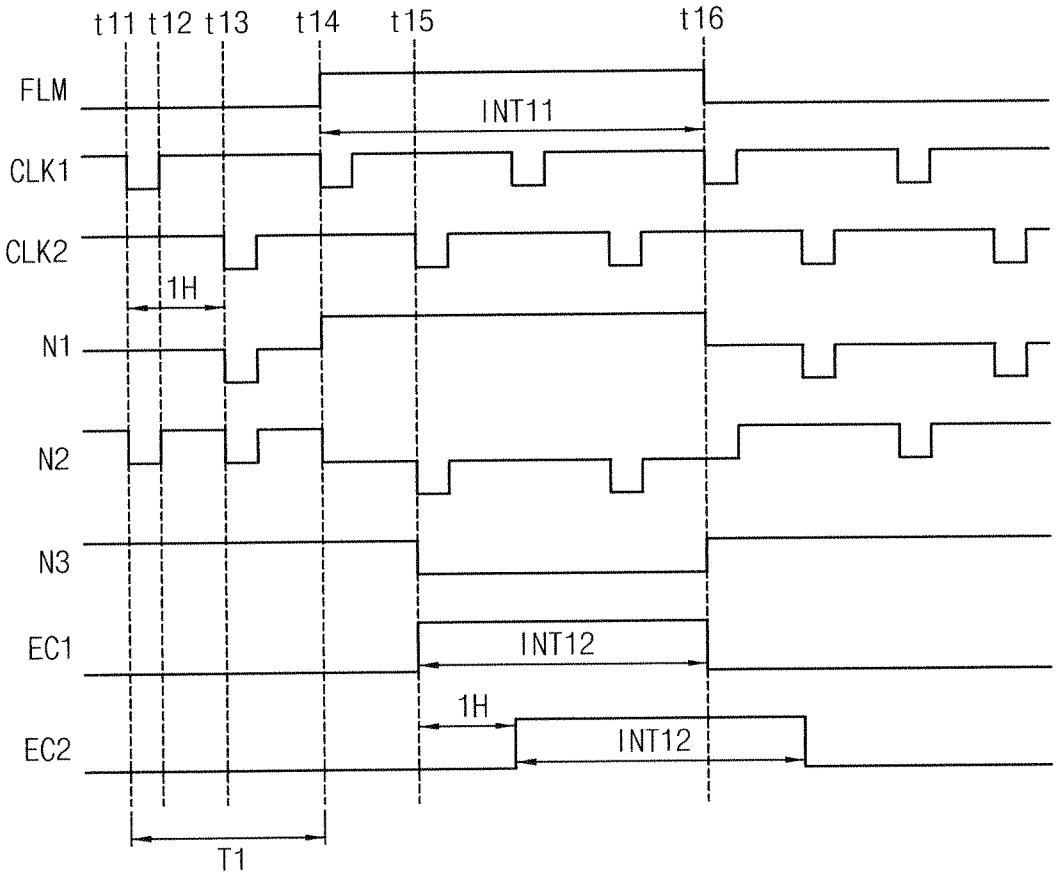
FIG. 35 is a timing diagram for explaining operation of the first stage in FIG. 34 when the black data is not used in the dimming mode, according to some example embodiments of the present invention.

FIG. 35 is a timing diagram for explaining operation of the first stage in FIG. 34 when the black data is not used in the dimming mode.

Referring to FIG. 35, the first clock signal CLK1 and the second clock signal CLK2 have the same frequency. That is, the first and second clock signals CLK1 and CLK2 have the same first period T1. The second clock signal CLK2 is obtained by shifting the first clock signal CLK1 by a half of the first period T1 of the first clock signal CLK1. The shift period between the first clock signal CLK1 and the second clock signal CLK2 is referred to as a first duration 1H.

The start signal FLM is applied to only the first stage STAGE1 and a high level duration of the start signal FLM is referred to as a second duration INT11. The second duration INT11 is two times greater than the first period T1 of the first and second clock signals CLK1 and CLK2. That is, the second duration INT11 is four times greater than the first duration 1H.

The start signal FLM changes from a low level to a high level when the first clock signal CLK1 changes from the high level to the low level. As described above, the start signal FLM maintains the high level during the second duration INT11 after being changing from the low level to the high level. That is, the start signal FLM is activated when the first clock signal CLK1 changes from the high level to the low level, and the activated state of the start signal FLM is maintained during the second duration INT11.

Hereinafter, a high level of each signal is referred to as a first level and a low level, lower than the high level, of each signal is referred to as a second level. In addition, the first voltage VGL has the second level and the second voltage VGH has the first level.

The start signal FLM and the first clock signal CLK1 have the second level at a first time point t11 and the second clock signal CLK2 has the first level at the first time point t11. The first clock signal CLK1 having the second level is applied to the gate terminal of the first transistor M1 and the gate terminal of the third transistor M3. Accordingly, the first and third transistors M1 and M3 are turned on.

The start signal FLM having the second level is applied to the gate terminal of the second transistor M2 and the first node N1 through the turned-on first transistor M1. Thus, the second transistor M2 is turned on and a voltage at the first node N1 has the second level. The first clock signal CLK1 having the second level and the first voltage VGL are applied to the second node N2 respectively through the turned-on second transistor M2 and the turned-on third transistor M3. Therefore, a voltage at the second node N2 has the second level.

The second clock signal CLK2 having the first level is applied to the fourth transistor M4 and the seventh transistor M7. Thus, the fourth and seventh transistors M4 and M7 are turned off. Because the voltage at the first node N1 has the second level, the eighth transistor M8 is turned on. The second voltage VGH is applied to the third node N3 through the turned-on eighth transistor M8.

Accordingly, a voltage at the third node N3 has the first level. The third capacitor C3 is charged with the second voltage VGH. In other words, the third capacitor C3 is charged with the voltage having the first level. Because the voltage at the third node N3 has the first level, the ninth transistor M9 is turned off. Because the voltage at the first node N1 has the second level, the tenth transistor M10 is turned on. Due to the turned-on tenth transistor M10, the first voltage VGL is applied to the first emission control line E1. Thus, the first emission control signal has the second level.

At a second time point t12, the start signal FLM has the second level and the first and second clock signals CLK1 and CLK2 have the first level. The first and third transistors M1 and M3 are turned off by the first clock signal CLK1 having the first level. Because the voltage at the first node N1 is maintained at the second level, the second transistor M2 is turned on. The first clock signal CLK1 having the first level is applied to the second node N2 through the turned-on second transistor M2.

Accordingly, the voltage at the second node N2 has the first level. The voltage at the first node N1 has the second level, and thus the eighth and tenth transistors M8 and M10 are turned on. The second voltage VGH is applied to the third node N3 through the turned-on eighth transistor M8, so that the voltage at the third node N3 is maintained at the first level. The ninth transistor M9 is turned off and the tenth transistor M10 is turned on because the voltage at the third node N3 has the first level and the voltage at the first node N1 has the second level. Accordingly, the first emission control signal is maintained at the second level.

At a third time point t3, the second clock signal CLK2 changes from the first level to the second level, and then changes from the second level to the first level again. Thus, an electric potential at the first node N1 is boot-strapped by a variation of electric potential of the second clock signal CLK2 due to the coupling of the first capacitor C1.

That is, the first node N1, which has the voltage with the second level at the second time point t2, has a voltage of a third level lower than the second level in the second level period of the second clock signal CLK2 due to the coupling of the first capacitor C1. A conventional PMOS transistor has good drive characteristics as the level of the voltage applied to the PMOS transistor becomes low. Because the voltage at the first node N1 has the third level lower than the second level in the second level period of the second clock signal CLK2, the drive characteristics of the eighth and tenth transistors M8 and M10 may be improved. The first emission control signal is maintained at the second level.

At a fourth time point t4, the start signal FLM and the second clock signal CLK2 have the first level and the first clock signal CLK1 has the second level. The first transistor M1 is turned on by the first clock signal CLK1 having the second level and the start signal FLM having the first level is applied to the first node N1. The voltage at the first node N1 has the first level, and thus the second and the tenth transistors M2 and M10 are turned off.

The third transistor M3 is turned on in response to the first clock signal CLK1 having the second level and the first voltage VGL is applied to the second node N2. Thus, the voltage at the second node N2 has the second level. The seventh transistor M7 is turned off in response to the second clock signal CLK2 having the first level. Because the voltage at the first node N1 has the first level, the eighth transistor M8 is turned off. The voltage at the third node N3 is maintained at the first level by the third capacitor C3. The voltage at the third node N3 is maintained at the first level, and thus the ninth transistor M9 is turned off. Therefore, the first emission control signal is maintained at the second level.

At a fifth time point t15, the start signal FLM and the first clock signal CLK1 have the first level, and the second clock signal CLK2 has the second level. The first and third transistors M1 and M3 are turned off by the first clock signal CLK1 having the first level. Because the voltage at the first node N1 is maintained at the first level, the second, eighth, and tenth transistors M2, M8, and M10 are turned off. The fourth and seventh transistors M4 and M7 are turned on in response to the second clock signal CLK2 having the second level. In addition, the voltage at the second node N2 has the second level, so that the fifth and sixth transistors M5 and M6 are turned on.

As the boot-strap described above, the electric potential of the second node N2 is boot-strapped by the variation of the electric potential of the second clock signal CLK2 due to the coupling of the second capacitor C2. That is, the voltage at the second node N2 has the third level lower than the second level in the second level period of the second clock signal CLK2.

The second clock signal CLK2 having the second level is applied to the third node N3 through the turned-on sixth and seventh transistors M6 and M7. Accordingly, the voltage at the third node N3 has the second level at the fifth time point t5. Because the voltage at the third node N3 has the second level, the ninth transistor M9 is turned on. The first emission control signal EC1 is maintained at the first level because the ninth transistor M9 is turned on and the tenth transistor M10 is turned off.

At a sixth time point t16, the start signal FLM and the first clock signal CLK1 have the second level and the second clock signal CLK2 has the first level. According to the operation at the first time point t21, the first emission control signal EC1 has the second level at the sixth time point t16. A duration in which the first emission control signal EC1 has the first level is referred to as a third duration INT12. The third duration INT12 is three times greater than the first duration 1H. The first emission control signal EC1 is provided to the second stage STAGE2 and the pixels through the first emission control line EL1.

The second stage STAGE2 generates the second emission control signal EC2 in response to the first emission control signal EC1, the first clock signal CLK1, and the second clock signal CLK2. The second emission control signal EC2 is output after being shifted by the first duration 1H with respect to the first emission control signal EC1. In other words, the emission control signals EC1~ECn output from the stages STAGE1~STAGEn are sequentially shifted by the first duration 1H.

The emission control signal output from the present stage is obtained by shifting the emission control signal output from the previous stage by the first duration 1H. During each of the emission control signals EC1~ECn having a first level, the pixels in the corresponding pixel row do not emit light.

When the OLED display device 100 performs a dimming operation by increasing non-emission periods to reduce luminance of the display panel 110 as described with reference to FIG. 35, defects such as stripe patterns in response to change of the data voltage may occur in the display panel 110.

Figure 36:
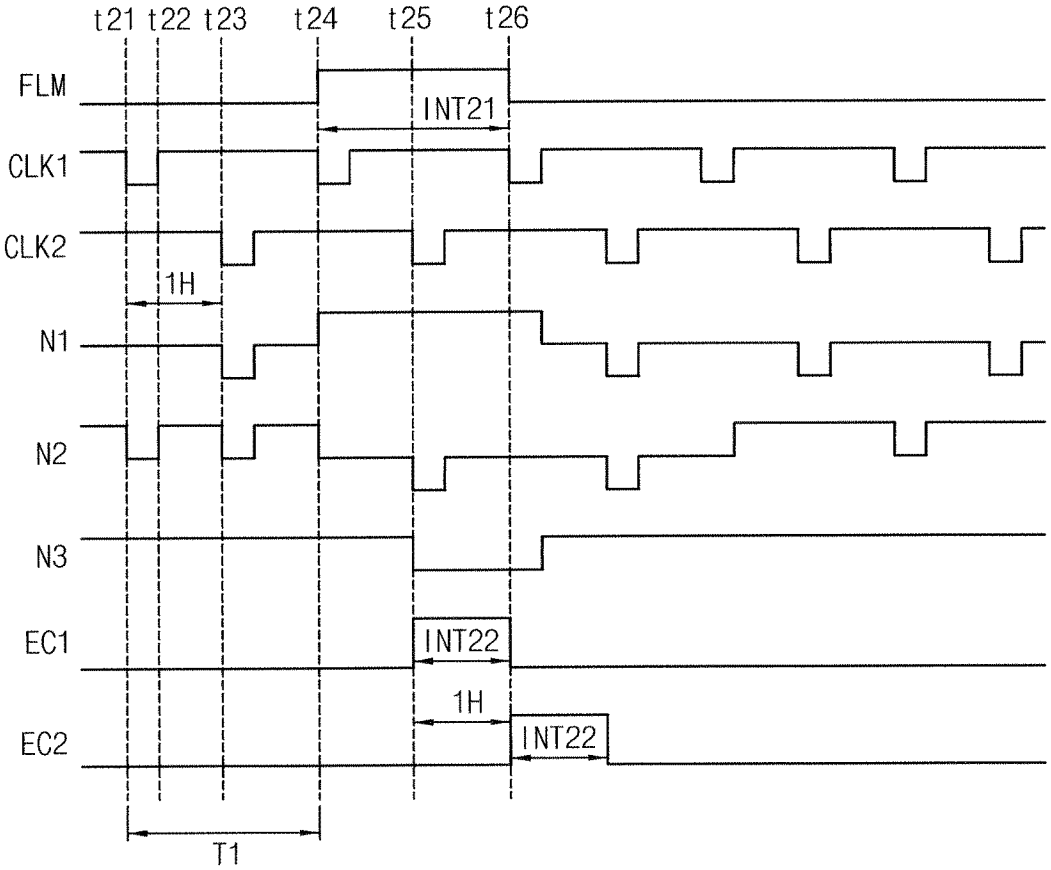
FIG. 36 is a timing diagram for explaining operation of the first stage in FIG. 34 when the black data is used in the dimming mode, according to some example embodiments of the present invention.

FIG. 36 is a timing diagram for explaining operation of the first stage in FIG. 34 when the black data is used in the dimming mode according to example embodiments.

Operation from a first time point t21 to a fifth time point t25 in FIG. 36 is substantially same as the operation from first time point t11 to the fifth time point t15 in FIG. 35.

In FIG. 36, a high level duration of the start signal FLM is referred to as a second duration INT21. The second duration INT is same as the first period T1 of the first and second clock signals CLK1 and CLK2. The start signal FLM maintains the high level during the second duration INT21 after being changing from the low level to the high level. That is, the start signal FLM is activated when the first clock signal CLK1 changes from the high level to the low level, and the activated state of the start signal FLM is maintained during the second duration INT21.

At a sixth time point t26, the start signal FLM and the first clock signal CLK1 have the second level and the second clock signal CLK2 has the first level. The first emission control signal EC1 has the second level at the sixth time point t26. A duration in which the first emission control signal EC1 has the first level is referred to as a third duration INT22. The third duration INT22 is one and a half times greater than the first duration 1H. The first emission control signal EC1 is provided to the second stage STAGE2 and the pixels through the first emission control line EL1.

The second stage STAGE2 generates the second emission control signal EC2 in response to the first emission control signal EC1, the first clock signal CLK1, and the second clock signal CLK2. The second emission control signal EC2 is output after being shifted by the first duration 1H with respect to the first emission control signal EC1. In other words, the emission control signals EC1~ECn output from the stages STAGE1~STAGEn are sequentially shifted by the first duration 1H. The emission control signal output from the present stage is obtained by shifting the emission control signal output from the previous stage by the first duration 1H. During each of the emission control signals EC1~ECn having a first level, the pixels in the corresponding pixel row do not emit light.

When the OLED display device 100 performs a dimming operation by providing the data voltage including the black data to the display panel 110 to reduce luminance of the display panel 110 as described with reference to FIG. 36, defects such as stripe patterns in response to change of the data voltage may be prevented from occurring in the display panel 110 and the luminance of the display panel 110 is not reduced as compared with a case of FIG. 35.

Figure 37:
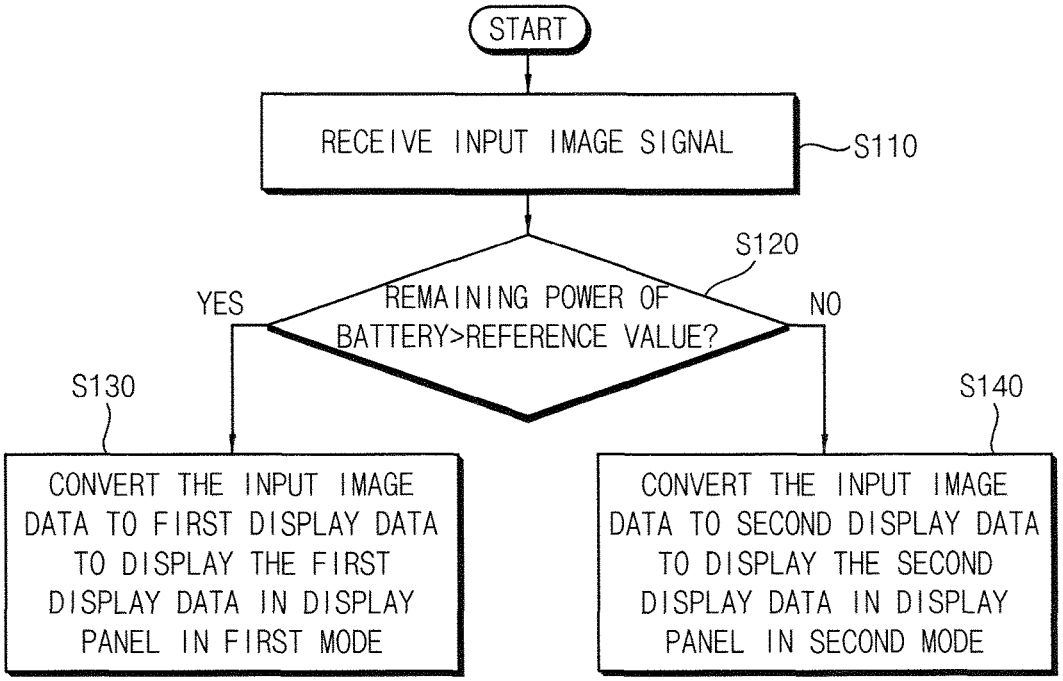
FIG. 37 is a flow chart illustrating a method of operating an OLED display device, according to some example embodiments of the present invention.

FIG. 37 is a flow chart illustrating a method of operating an OLED display device according to example embodiments.

Figure 38:
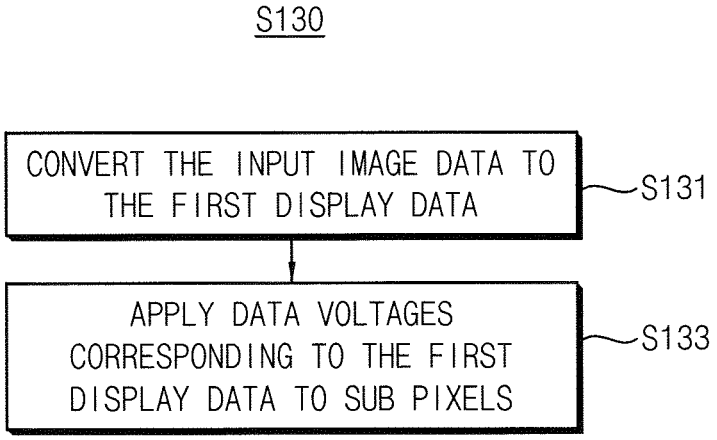
FIG. 38 is a flow chart illustrating operation of a first mode in the method of operating an OLED display device of FIG. 37.

FIG. 38 is a flow chart illustrating operation of a first mode in the method of operating an OLED display device of FIG. 37.

Figure 39:
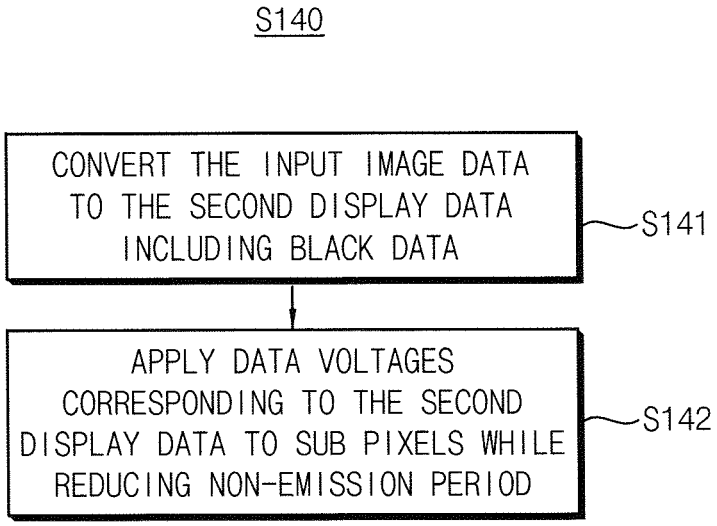
FIG. 39 is a flow chart illustrating operation of a second mode in the method of operating an OLED display device of FIG. 37.

FIG. 39 is a flow chart illustrating operation of a second mode in the method of operating an OLED display device of FIG. 37.

In FIGS. 37 to 39, it is assumed that the display panel 110 is a pentile configuration.

Referring to FIGS. 1 through 15 and 37 through 39, the timing controller 130 receives the input image signal RGB (S110). The battery sensing module 183 in the power supply 180 determines whether remaining power of the battery 181 is greater than a reference value to provide the mode signal generator 190 with the battery sensing signal BS indicating whether the remaining power of the battery 181 is greater than the reference value (S120).

When the battery sensing signal BS indicates that the remaining power of the battery 181 is greater than the reference value, the timing controller 130 converts the input image data RGB to the first display data DTA1 not including the black data to provide the first display data DTA1 to the data driver 150 in a first mode (e.g., the normal mode (S130)). When the battery sensing signal BS indicates that the remaining power of the battery 181 is not greater than the reference value, the timing controller 130 converts the input image data RGB to the second display data DTA2 including the black data to provide the second display data DTA2 to the data driver 150 in a second mode (e.g., the dimming mode (S140)).

In the normal mode, the data converter 140 of the timing controller 130 converts the first display data DTA1 conforming to a pentile configuration to provide the first display data DTA1 to the data driver 150 (S131). The data driver 150 applies data voltages corresponding to the first display data DTA1 to the pixel rows in the display panel such that an image corresponding to the input image signal RGB is displayed on the display panel 110 in the normal mode (S133).

In the dimming mode, the data converter 140 of the timing controller 130 converts the second display data DTA2 including the black data and conforming to a pentile configuration to provide the second display data DTA2 to the data driver 150 (S141). The emission driver 170 reduces non-emission interval of the sub pixels and the data driver 150 applies data voltages corresponding to the second display data DTA2 to the pixel rows in the display panel such that luminance of the display panel 110 is reduced (S143).

Figure 40:
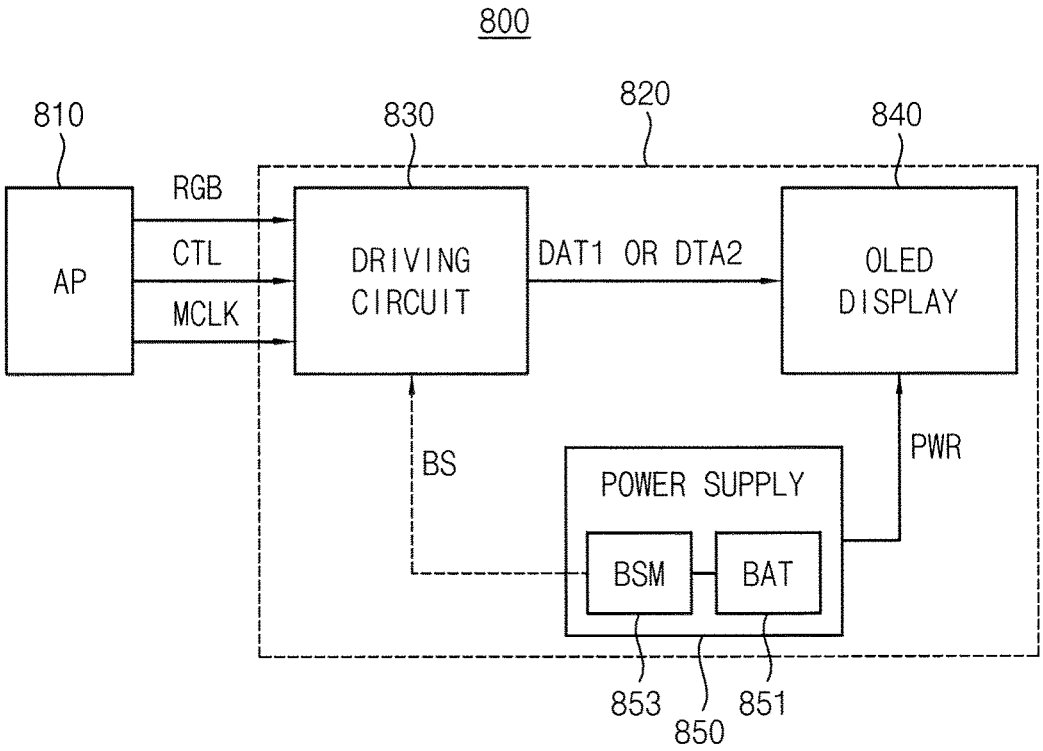
FIG. 40 is a block diagram illustrating a display system, according to some example embodiments of the present invention.

FIG. 40 is a block diagram illustrating a display system according to example embodiments.

Referring to FIG. 4, a display system 800 may include an application processor 810 and an OLED display device 820. The OLED display device 820 may include a driving circuit 830, a display panel 840 and a power supply 850. The power supply 850 may include a rechargeable battery 851 and a battery sensing module 853. The power supply 850 may provides a power PWR to the display panel 840. The battery sensing module 853 may sense remaining power of the rechargeable battery 851 to output a battery sensing signal BS to the driving circuit 830.

The display system 800 may be a portable device such as a laptop, a cellular phone, a smart phone, a personal computer (PC), a personal digital assistant (PDA), a portable multimedia player (PMP), a MP3 player, a navigation system, etc.

The application processor 810 provides an image signal RGB, a control signal CTL and a main clock signal MCLK to the OLED display device 820.

The driving circuit 830, the display panel 840 and the power supply 850 are substantially same as the driving circuit 105, the display panel 110*d* the power supply 180, respectively. Therefore, the display system 800 operates in a normal mode or a dimming mode in which the driving circuit 830 reduces luminance of the display panel 840 based on the battery sensing signal BS. The display system 800 converts the image data RGB to a first display data DTA1 not including the black data, to display the first display data DTA1 in the display panel 840 in the normal mode and converts the image data RGB to a second display data DTA1 including the black data, to display the second display data DTA2 in the display panel 840 in the dimming mode while reducing non-emission periods to prevent the stripe pattern in the dimming mode.

Figure 41:
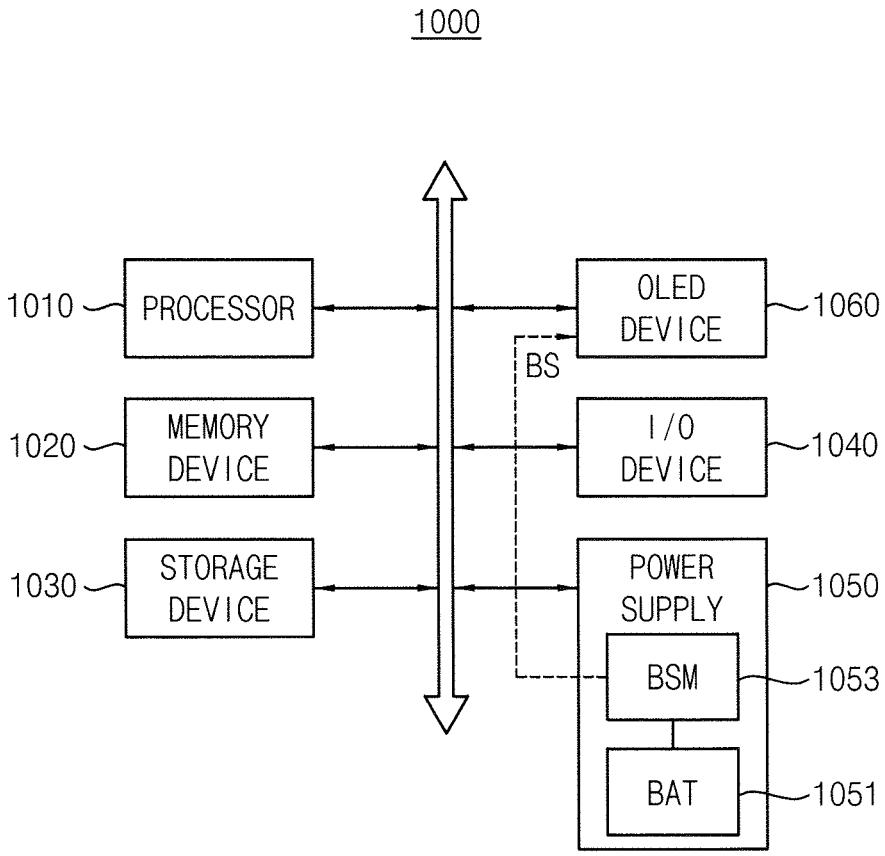
FIG. 41 a block diagram illustrating an electronic device including an OLED display device, according to some example embodiments of the present invention.

FIG. 41 a block diagram illustrating an electronic device including an OLED display device according to example embodiments.

Referring to FIG. 41, an electronic system 1000 includes a processor 1010, a memory device 1020, a storage device 1030, an input/output (I/O) device 1040, a power supply 1050, and an (OLED) display device 1060. The power supply 1050 may include a rechargeable battery 1051 and a battery sensing module 105353. The power supply 850 may provide power of operation of the electronic system 1000. The battery sensing module 1053 may sense remaining power of the rechargeable battery 1051 to output a battery sensing signal BS to the OLED device 1060. The electronic device 1000 may further include a plurality of ports for communicating a video card, a sound card, a memory card, a universal serial bus (USB) device, other electronic systems, etc.

The processor 1010 may perform various computing functions or tasks. The processor 1010 may be for example, a microprocessor, a central processing unit (CPU), etc. The processor 1010 may be connected to other components via an address bus, a control bus, a data bus, etc. Further, the processor 1010 may be coupled to an extended bus such as a peripheral component interconnection (PCI) bus.

The memory device 1020 may store data for operations of the electronic system 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc, and/or an output device such as a printer, a speaker, etc. The power supply 1050 may supply power for operations of the electronic system 1000. The organic light emitting display device 1060 may communicate with other components via the buses or other communication links.

The OLED display device 1060 may employ the OLED display device 100 of FIG. 1. Therefore, the OLED display device 1060 operates in a normal mode or a dimming mode in which luminance of the display panel is reduced based on the battery sensing signal BS. The OLED display device 1060 converts the image data to a first display data not including the black data, to display the first display data in the display panel in the normal mode and converts the image data to a second display data including the black data, to display the second display data in the display panel in the dimming mode while reducing non-emission periods to prevent the stripe pattern in the dimming mode.

The present embodiments may be applied to any electronic device 1000 having the organic light emitting display device 1060. For example, the present embodiments may be applied to the electronic system 1000, such as a television, a computer monitor, a laptop, a digital camera, a cellular phone, a smart phone, a personal digital assistant (PDA), a portable multimedia player (PMP), a MP3 player, a navigation system, a video phone, etc.

The present invention may be applied to any display device or any electronic device including a display device displaying a stereoscopic image. For example, the present invention may be applied to a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and aspects of the present invention. Accordingly, all such modifications are intended to be included within the scope of the present invention as defined in the claims, and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. An organic light emitting diode (OLED) display device, comprising:

a display panel comprising a plurality of pixel rows;

a driving circuit configured to:

provide a first display data to the plurality of pixel rows in a normal mode;

provide a second display data comprising black data to the plurality of pixel rows in a dimming mode, in response to a mode signal; and decrease a second luminance of the display panel in the dimming mode to a level lower than a first luminance of the display panel in the normal mode;

a data converter configured to convert input image data to the first display data or the second display data in response to the mode signal, wherein the data converter comprises a switch configured to receive the input image data, a first processing logic configured to convert the input image data to the first display data, and a second processing logic configured to convert the input image data to the second display data comprising the black data, the black data assigning a portion of pixels of the display panel to not emit light, the data converter being configured to control, via the switch based on the mode signal, a path of the input image data through the switch to the first processing logic or the second processing logic and output the first display data or the second display data from the first processing logic or the second processing logic, respectively, to the driving circuit; and a power supply configured to apply a lower power supply voltage and a high power supply voltage to the display panel, the power supply providing the mode signal.

2. The OLED display device of claim 1, wherein the plurality of pixel rows comprise a plurality of odd-numbered pixel rows and a plurality of even-numbered pixel rows that are alternately arranged with respect to each other, wherein each of the plurality of odd-numbered pixel rows comprises first pixels and second pixels that are alternately arranged with respect to each other, wherein each of the plurality of even-numbered pixel rows comprises third pixels and fourth pixels that are alternately arranged with respect to each other, and wherein each first pixel comprises a first sub pixel configured to emit a first color light and a second sub pixel configured to emit a second color light, each second pixel comprising a third sub pixel configured to emit a third color light and the second sub pixel configured to emit the second color light, each third pixel comprising the third sub pixel and the second sub pixel and each fourth pixel comprising the first sub pixel and the second sub pixel.

3. The OLED display device of claim 2, wherein the driving circuit is configured to provide black data to the second sub pixels of the second pixel and the fourth pixel in the dimming mode.

4. The OLED display device of claim 2, wherein the driving circuit, in the diming mode, is configured to:

provide black data to the second sub pixels of the second pixel and the fourth pixel during a k-th frame period (k is an integer greater than 0); and provide the black data to the second sub pixels of the first pixel and the third pixel during a (k+1)-th frame period.

5. The OLED display device of claim 2, wherein the driving circuit, in the diming mode, is configured to:

provide black data to the second sub pixels of the second pixel and the third pixel during a k-th frame period (k is an integer greater than 0); and provide the black data to the second sub pixels of the first pixel and the fourth pixel during a (k+1)-th frame period.

6. The OLED display device of claim 2, wherein the driving circuit, in the diming mode, is configured to:

provide black data to the pixels in the even-numbered pixel rows during a k-th frame period (k is an integer greater than 0); and provide the black data to the pixels in the odd-numbered pixel rows during a (k+1)-th frame period.

7. The OLED display device of claim 2, wherein the driving circuit, in the diming mode, is configured to:

provide black data to the second pixels and the fourth pixels during a k-th frame period (k is an integer greater than 0); and provide the black data to the first pixels and the third pixels during a (k+1)-th frame period.

8. The OLED display device of claim 2, wherein the first color light is a red color light, the second color light is a green color light, and the third color light is a blue color light.

9. The OLED display device of claim 2, wherein the driving circuit comprises:

a scan driver configured to provide scan signals to the sub pixels through a plurality of scan lines;

a data driver configured to provide data voltages corresponding to the first display data or the second display data to the sub pixels through a plurality of data lines;

an emission driver configured to provide emission control signals to the sub pixels through a plurality of a plurality of emission control lines to adjust non-emission time of each sub pixels in the dimming mode;

a timing controller configured to control the scan driver, the data driver, the emission driver and the power supply, wherein the timing controller is configured to process an input image data to generate the first display data or the second display data in response to the mode signal.

10. The OLED display device of claim 9, wherein each of the sub pixels comprises:

a switching transistor comprising a first terminal coupled to each of the data lines, a gate terminal coupled to each of the scan lines and a second terminal coupled to a first node;

a storage capacitor between the high power supply voltage and the first node;

a driving transistor comprising a first terminal coupled to the high power supply voltage, a gate terminal coupled to the first node and a second terminal;

an emission transistor comprising a first terminal coupled to a second terminal of the driving transistor, a gate terminal configured to receive the emission control signal and a second terminal; and an OLED between the second terminal of the driving transistor and a lower power supply voltage.

11. The OLED display device of claim 9, wherein the timing controller comprises:

a signal generator configured to generate a first driving control signal that controls the data driver, a second driving control signal that controls the scan driver, a third driving control signal that controls the emission driver and a power control signal that controls the power supply, in response to a control signal and the mode signal.

12. The OLED display device of claim 11, wherein the data converter comprises:

the first processing logic configured to process the input image data to provide the first display data to the data driver in the normal mode; and the second processing logic configured to process the input image data to provide the second display data to the data driver in the dimming mode.

13. The OLED display device of claim 1, wherein the plurality of pixel rows comprise a plurality of odd-numbered pixel rows and a plurality of even-numbered pixel rows that are alternately arranged with respect to each other, wherein each of the plurality of odd-numbered pixel rows comprises first pixels and second pixels that are alternately arranged with respect to each other, wherein each of the plurality of even-numbered pixel rows comprises third pixels and fourth pixels that are alternately arranged with respect to each other, and wherein each of the first through fourth pixels comprises a first sub pixel configured to emit a first color light, a second sub pixel configured to emit a second color light, and a third sub pixel configured to emit a third color light.

14. The OLED display device of claim 13, wherein the driving circuit, in the diming mode, is configured to:

provide black data to a same pixel of the first pixel and the third pixel during a k-th frame period (k is an integer greater than 0); and provide the black data to a same sub pixel of the second pixel and the fourth pixel during a (k+1)-th frame period.

15. The OLED display device of claim 14, wherein the same sub pixel is one of the first through third sub pixels.

16. The OLED display device of claim 13, wherein the driving circuit, in the diming mode, is configured to:

provide black data to a same pixel of the first pixel and the fourth pixel during a k-th frame period (k is an integer greater than 0); and provide the black data to the same sub pixel of the second pixel and the third pixel during a (k+1)-th frame period.

17. The OLED display device of claim 16, wherein the same sub pixel is one of the first through third sub pixels.

18. The OLED display device of claim 13, wherein the driving circuit, in the diming mode, is configured to:

provide black data to the first pixel and the fourth pixel during a k-th frame period (k is an integer greater than 0); and provide the black data to the second pixel and the third pixel during a (k+1)-th frame period.

19. The OLED display device of claim 13, wherein the first color light is a red color light, the second color light is a green color light and the third color light is a blue color light.

20. A display system comprising:

an application processor configured to generate image data and a control signal;

an organic light emitting diode (OLED) display device configured to display the image data in response to the control signal; and a power supply comprising a battery configured to provide a power supply voltage to the OLED display device and a battery sensing module configured to detect a power of the battery, wherein the OLED display device comprises:

a display panel comprising a plurality of pixel rows;

a driving circuit configured to:

provide a first display data to the plurality of pixel rows in a normal mode;

provide a second display data including black data to the plurality of pixel rows in a dimming mode, in response to a mode signal; and a data converter configured to:

convert input image data to the first display data or the second display data in response to the mode signal, wherein the data converter comprises a switch configured to receive the input image data, a first processing logic configured to convert the input image data to the first display data, and a second processing logic configured to convert the input image data to the second display data comprising the black data, the black data assigning a portion of pixels of the display panel to not emit light, the data converter being configured to control a path of the input image data through the switch to the first processing logic or the second processing logic and output the first display data or the second display data from the first processing logic or the second processing logic, respectively, to the driving circuit; and reduce a second luminance of the display panel in the dimming mode to a lower level than a first luminance of the display panel in the normal mode, the mode signal being based on a battery sensing signal that the battery sensing module generates based on the power of the battery.

* * * * *